US011829105B2

(12) United States Patent
Suzuki et al.

(10) Patent No.: US 11,829,105 B2
(45) Date of Patent: Nov. 28, 2023

(54) IMAGE FORMING METHOD AND IMAGE FORMING APPARATUS

(71) Applicant: CANON KABUSHIKI KAISHA, Tokyo (JP)

(72) Inventors: Ai Suzuki, Tokyo (JP); Kazuhiro Funatani, Kanagawa (JP); Kensuke Umeda, Kanagawa (JP); Shinsuke Kobayashi, Kanagawa (JP); Masamichi Sato, Shizuoka (JP); Masatake Tanaka, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 132 days.

(21) Appl. No.: 17/145,896

(22) Filed: Jan. 11, 2021

(65) Prior Publication Data

US 2021/0223731 A1 Jul. 22, 2021

(30) Foreign Application Priority Data

Jan. 16, 2020 (JP) ..... 2020-005522

(51) Int. Cl.
*G03G 9/093* (2006.01)
*G03G 15/20* (2006.01)

(52) U.S. Cl.
CPC ..... *G03G 9/09328* (2013.01); *G03G 9/0935* (2013.01); *G03G 9/09307* (2013.01); *G03G 15/206* (2013.01); *G03G 15/2064* (2013.01)

(58) Field of Classification Search
CPC ..... G03G 9/09328; G03G 9/09307; G03G 9/0935; G03G 15/2064
See application file for complete search history.

(56) References Cited

U.S. PATENT DOCUMENTS 7,833,685 B2 11/2010 Tanaka et al.
8,377,616 B2 2/2013 Tani et al.
(Continued)

FOREIGN PATENT DOCUMENTS

JP 2002-258514 A 9/2002
JP 2005-148455 A 6/2005
(Continued)

OTHER PUBLICATIONS

English machine translation of the description of JP-2018194837-A (Year: 2018).*

*Primary Examiner* — Peter L Vajda
*Assistant Examiner* — Boone Alexander Evans
(74) *Attorney, Agent, or Firm* — VENABLE LLP

(57) ABSTRACT

An image forming method comprising a fixing step of fixing a toner image to a recording material while nipping and conveying the recording material, on which the toner image has been formed, by a fixing nip portion, wherein the toner comprises a toner particle comprising a toner base particle and an organosilicon polymer on a surface thereof, the organosilicon polymer has a structure represented by R—$SiO_{3/2}$, where R is an C1 to C6 alkyl group or a phenyl group, the organosilicon polymer has convex portions formed on an outer surface thereof, and the convex portions satisfy specific relationships, and a contact pressure σ (MPa) of the pressure member and the fixing film and a storage elastic modulus G (MPa) of the toner at a temperature of a surface of the fixing film when the recording material is nipped and conveyed by the fixing nip portion satisfy specific relationships.

7 Claims, 12 Drawing Sheets

(56) References Cited

U.S. PATENT DOCUMENTS

| | | | | |
|---|---|---|---|---|
| 8,628,899 | B2 | 1/2014 | Kawamura et al. | |
| 8,737,892 | B2 * | 5/2014 | Oba | G03G 15/2032 399/33 |
| 8,815,484 | B2 | 8/2014 | Tanaka et al. | |
| 9,158,216 | B2 | 10/2015 | Shimano et al. | |
| 9,377,705 | B2 | 6/2016 | Shimano et al. | |
| 9,383,668 | B2 | 7/2016 | Noji et al. | |
| 9,500,972 | B2 | 11/2016 | Tanaka et al. | |
| 9,575,424 | B2 | 2/2017 | Nakagawa et al. | |
| 9,599,919 | B2 | 3/2017 | Isono et al. | |
| 9,658,549 | B2 | 5/2017 | Tanaka et al. | |
| 9,785,007 | B2 | 10/2017 | Kim et al. | |
| 9,785,071 | B2 | 10/2017 | Shimano et al. | |
| 9,829,816 | B2 | 11/2017 | Tanaka et al. | |
| 9,835,964 | B2 | 12/2017 | Yoshida et al. | |
| 9,904,193 | B2 | 2/2018 | Nakagawa et al. | |
| 9,958,801 | B2 | 5/2018 | Tanaka et al. | |
| 10,054,866 | B2 | 8/2018 | Tanaka et al. | |
| 10,678,155 | B2 | 6/2020 | Terui et al. | |
| 10,747,133 | B2 | 8/2020 | Yagi et al. | |
| 10,809,639 | B2 | 10/2020 | Yamawaki et al. | |
| 10,845,721 | B2 | 11/2020 | Tanaka et al. | |
| 2005/0238984 | A1 * | 10/2005 | Kaburagi | G03G 9/08782 430/110.3 |
| 2010/0035171 | A1 | 2/2010 | Watanabe et al. | |
| 2014/0356779 | A1 | 12/2014 | Hasegawa et al. | |
| 2018/0329328 | A1 | 11/2018 | Tanaka | |
| 2019/0171141 | A1 | 6/2019 | Fujii et al. | |
| 2019/0369529 | A1 | 12/2019 | Yagi | |
| 2020/0124998 | A1 | 4/2020 | Kototani et al. | |
| 2020/0209767 | A1 | 7/2020 | Sato et al. | |
| 2020/0209773 | A1 | 7/2020 | Tominaga et al. | |
| 2020/0209774 | A1 | 7/2020 | Katsura et al. | |
| 2020/0209775 | A1 | 7/2020 | Tanaka et al. | |
| 2020/0209776 | A1 | 7/2020 | Kototani et al. | |
| 2021/0003932 | A1 | 1/2021 | Tsuda et al. | |

FOREIGN PATENT DOCUMENTS

| | | | | |
|---|---|---|---|---|
| JP | 2006276825 | A | 10/2006 | |
| JP | 2008097041 | A | 4/2008 | |
| JP | 2009-288537 | A | 12/2009 | |
| JP | 2011-33671 | A | 2/2011 | |
| JP | 2015096949 | A | 5/2015 | |
| JP | 2018189895 | A | 11/2018 | |
| JP | 2018194837 | A * | 12/2018 | G03G 9/08 |
| JP | 2019-12188 | A | 1/2019 | |
| JP | 2019-56897 | A | 4/2019 | |
| JP | 2019101314 | A | 6/2019 | |
| JP | 2019-211774 | A | 12/2019 | |

* cited by examiner

Spherical Ratio
24.8%

Spherical Ratio
84.34%

IMAGE FORMING METHOD AND IMAGE FORMING APPARATUS

BACKGROUND OF THE INVENTION

Field of the Invention

The present disclosure relates to an image forming method and an image forming apparatus for forming an image on a recording material by using a toner.

Description of the Related Art

In an electrophotographic method, first, an image bearing member is charged by various means and exposed to form an electrostatic latent image on the surface of the image bearing member. Next, the electrostatic latent image is developed with a toner to form a toner image, and the toner image is transferred to a transfer material such as paper. Then, the toner image is fixed on the transfer material by heat, pressure, or heating and pressurization to obtain a copy or a print.

In Japanese Patent Application Publication No. 2006-276825 and Japanese Patent Application Publication No. 2008-97041, a decrease in gloss of images is required for the purpose of improving the visibility of printed images, in particular, character images.

SUMMARY OF THE INVENTION

In a known means for reducing the gloss of images, toner base particles are thermally hardened to some extent (the storage elastic modulus of the toner base particles is increased) so that the toner is not completely melted after fixing and the image surface is not smoothed. However, it has been found that when such a toner is used, offset may occur in which the toner on a sheet after fixing moves to a fixing film and contaminates members.

This contamination appears as stains on a subsequent printed image, causing image damage. As a countermeasure against member contamination, it is conceivable to improve the adhesiveness between the toner and paper by raising the fixing temperature, but at the same time, the gloss of the image also increases, which is a trade-off with low gloss. Thus, it has been desired to achieve both low gloss of the image and suppression of member contamination.

The present disclosure provides an image forming method and an image forming apparatus capable of achieving both low gloss of an image and suppression of toner contamination on a fixing film.

A first image forming method of the present disclosure is an image forming method for an image forming apparatus comprising an image forming unit that forms a toner image on a recording material, and a fixing unit that fixes the toner image, formed on the recording material, to the recording material, wherein the fixing unit comprises a fixing film, a heating member provided in an inner space of the fixing film, and a pressure member that forms, together with the heating member, a fixing nip portion, with the fixing film being interposed between the pressure member and the heating member, the image forming method comprises a fixing step of fixing the toner image to the recording material while nipping and conveying the recording material, on which the toner image has been formed, by the fixing nip portion, the toner comprises a toner particle comprising a toner base particle and an organosilicon polymer on a surface of the toner base particle, the organosilicon polymer has a structure represented by a following formula (1):

$$R—SiO_{3/2} \quad (1),$$

where, R is an alkyl group having from 1 to 6 carbon atoms or a phenyl group, the organosilicon polymer has convex portions formed on an outer surface of the toner particle, and when a contour line of the toner base particle in a cross-sectional image of the toner particle obtained by scanning transmission electron microscopy is straightened to a straight line and a straightened image of the cross-sectional image is obtained, and when in the straightened image.

a length of the straight line is L, a length of a line segment of a portion constituting a boundary of the convex portion and the toner base particle in the straight line is a convex portion width W, a maximum length of the convex portion in a normal direction of the convex portion width W is a convex portion diameter D, and a length to the straight line from an apex of the convex portion in the line segment forming the convex portion diameter D is a convex portion height H, $$\text{the convex portion diameter } D = \text{the convex portion height } H \quad (2), \text{ and}$$

when a contact pressure of the pressure member and the fixing film is σ (MPa) and a storage elastic modulus of the toner at a temperature of a surface of the fixing film when the recording material is nipped and conveyed by the fixing nip portion is G (MPa), following formulas (3) and (4) are satisfied:

$$G \geq 0.060 \text{ MPa} \quad (3)$$

$$G \geq \sigma \times 0.6 \quad (4).$$

A second image forming method of the present disclosure is an image forming method for an image forming apparatus comprising an image forming unit that forms a toner image on a recording material, and a fixing unit that fixes the toner image, formed on the recording material, to the recording material, wherein the fixing unit comprises a fixing film, a heating member provided in an inner space of the fixing film, a holding member that holds the heating member, and a pressure member that forms, together with the heating member, a fixing nip portion, with the fixing film being interposed between the pressure member and the heating member, the image forming method comprises a fixing step of fixing the toner image to the recording material while nipping and conveying the recording material, on which the toner image has been formed, by the fixing nip portion, the holding member comprises, on a downstream side of the heating member in recording material conveying direction, a surface at a same height as a surface of the heating member that contacts an inner surface of the fixing film, and comprises, on a further downstream side in the recording material conveying direction than the surface, a step formed by a protruding portion projecting from the surface toward the pressure member, the toner comprises a toner particle comprising a toner base particle and an organosilicon polymer on a surface of the toner base particle, the organosilicon polymer has a structure represented by a following formula (1):

$$R—SiO_{3/2} \quad (1),$$

where, R is an alkyl group having from 1 to 6 carbon atoms or a phenyl group, the organosilicon polymer has convex portions formed on an outer surface of the toner particle, and when a contour line of the toner base particle in a cross-sectional image of the toner particle obtained by scanning transmission electron microscopy is straightened to a straight line and a straightened image of the cross-sectional image is obtained, and when in the straightened image, a length of the straight line is L, a length of a line segment of a portion constituting a boundary of the convex portion and the toner base particle in the straight line is a convex portion width W, a maximum length of the convex portion in a normal direction of the convex portion width W is a convex portion diameter D, and a length to the straight line from an apex of the convex portion in the line segment forming the convex portion diameter D is a convex portion height H, $$\text{the convex portion diameter } D = \text{the convex portion height } H \quad (2), \text{ and}$$

when a contact pressure of the pressure member and the fixing film is σ (MPa) and a storage elastic modulus of the toner at a temperature of a surface of the fixing film when the recording material is nipped and conveyed by the fixing nip portion is G (MPa), following formulas (3) and (4) are satisfied:

$$G \geq 0.060 \text{ MPa} \quad (3)$$

$$G \geq \sigma \times 0.6 \quad (4).$$

An image forming apparatus of the present disclosure is an image forming apparatus comprising an image forming unit that forms a toner image on a recording material, and a fixing unit that fixes the toner image, formed on the recording material, to the recording material, wherein the fixing unit comprises a fixing film, a heating member provided in an inner space of the fixing film, and a pressure member that forms, together with the heating member, a fixing nip portion, with the fixing film being interposed between the pressure member and the heating member, the toner comprises a toner particle comprising a toner base particle and an organosilicon polymer on a surface of the toner base particle, the organosilicon polymer has a structure represented by a following formula (1):

$$R—SiO_{3/2} \quad (1),$$

where, R is an alkyl group having from 1 to 6 carbon atoms or a phenyl group, the organosilicon polymer has convex portions formed on an outer surface of the toner particle, and when a contour line of the toner base particle in a cross-sectional image of the toner particle obtained by scanning transmission electron microscopy is straightened to a straight line and a straightened image of the cross-sectional image is obtained, and when in the straightened image, a length of the straight line is L, a length of a line segment of a portion constituting a boundary of the convex portion and the toner base particle in the straight line is a convex portion width W, a maximum length of the convex portion in a normal direction of the convex portion width W is a convex portion diameter D, and a length to the straight line from an apex of the convex portion in the line segment forming the convex portion diameter D is a convex portion height H, $$\text{the convex portion diameter } D = \text{the convex portion height } H \quad (2), \text{ and}$$

when a contact pressure of the pressure member and the fixing film is σ (MPa) and a storage elastic modulus of the toner is G' (MPa), following formulas (3') and (4') are satisfied:

$$G' \geq 0.060 \text{ MPa} \quad (3')$$

$$G' \geq \sigma \times 0.6 \quad (4').$$

According to the present disclosure, an image forming method and an image forming apparatus capable of achieving both low gloss of an image and suppression of toner contamination on a fixing film can be provided.

Further features of the present invention will become apparent from the following description of exemplary embodiments with reference to the attached drawings.

DESCRIPTION OF THE EMBODIMENTS

Hereinafter, embodiments of the above image forming method and image forming apparatus will be described, but the present disclosure is not limited to the following embodiments.

Unless otherwise specified, the description of "from XX to YY" or "XX to YY" indicating a numerical range means a numerical range including a lower limit and an upper limit which are end points.

When the numerical range is described in a stepwise manner, the upper and lower limits of each numerical range can be arbitrarily combined.

First Embodiment

Image Forming Method and Image Forming Apparatus

The image forming apparatus according to the first embodiment will be described using the image forming apparatus shown in FIG. 1. The configuration is the same as that of a general monochrome image forming apparatus except for the conditions for applying pressure to the fixing unit described hereinbelow.

Figure 1:
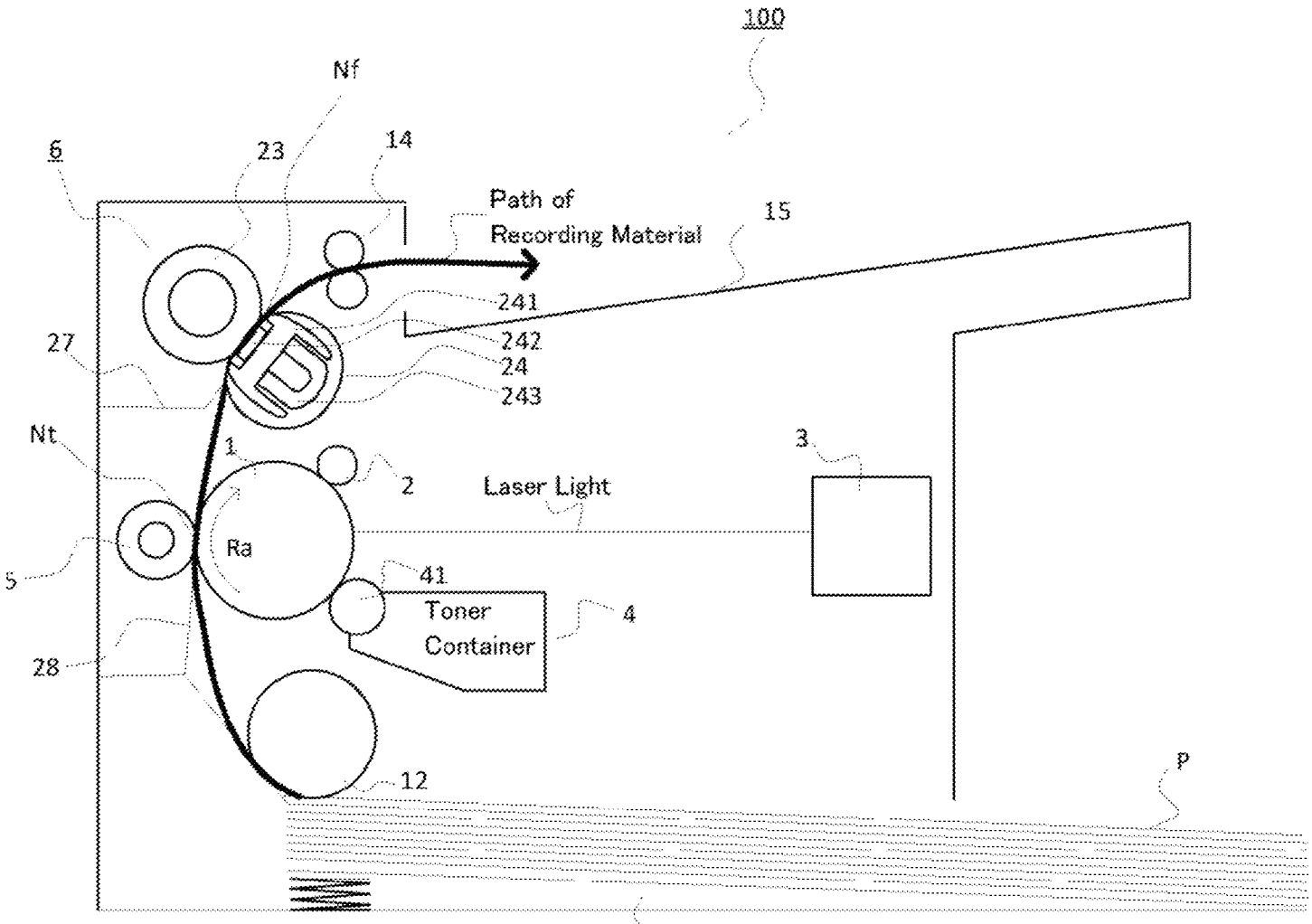
FIG. 1 is a schematic cross-sectional view of an image forming apparatus.

The image forming apparatus shown in FIG. 1 includes a drum-type electrophotographic photosensitive member (photosensitive drum) 1 as an image bearing member. The photosensitive drum 1 is rotatably supported by an apparatus main body 100, and is rotationally driven by a driving means (not shown) at a process speed of about 130 mm/sec (23 sheets/minute for letter size paper) in the direction of arrow Ra. The process speed is not limited to 130 mm/sec and can be set arbitrarily.

Around the photosensitive drum 1, a charging roller (charging device) 2, an exposure means 3, a developing device 4, and a transfer roller (transfer device) 5 are arranged in the order of description along the rotation direction Ra. Here, the photosensitive drum 1 and the transfer roller 5 function as transfer members that form a transfer nip portion Nt.

A paper cassette (paper tray) 11 accommodating a recording material (paper) P is arranged at the lower part of the apparatus main body 100. A paper feed roller 12, a conveying guide 28, a fixing inlet guide 27, a fixing unit (fixing device) 6, and a paper ejection roller 14 are arranged in this order along the conveying path (arrow in the drawing) of the paper P. The image forming apparatus may comprise a toner container having toner.

The photosensitive drum 1 rotationally driven in the direction of arrow Ra by a driving means (not shown) is uniformly charged to a predetermined polarity and a predetermined potential by the charging roller 2. After charging, image exposure of the surface of the photosensitive drum 1 is performed based on image information by the exposure means 3 such as a laser optical system, and the charge on the exposed portion is removed to form an electrostatic latent image. The electrostatic latent image is developed by the developing device 4. The developing device 4 has a developing roller 41, and applies a developing bias to the developing roller 41 to attach toner to the electrostatic latent image on the photosensitive drum 1 and develop (visualize) the electrostatic latent image as a toner image (toner image).

Then, the toner image is transferred to the paper P by the transfer roller 5. The paper P accommodated in the paper cassette 11 is fed by the paper feed roller 12, and is conveyed to the transfer nip portion Nt between the photosensitive drum 1 and the transfer roller 5 along the conveying guide 28. A transfer bias is applied to the transfer roller 5, whereby the toner image on the photosensitive drum 1 is transferred to a predetermined position on the paper P.

The photosensitive drum 1, the charging roller 2, the exposure means 3, the developing device 4, and the transfer roller 5 described above form an image forming unit for forming an unfixed toner image on the recording material P.

The fixing step will be explained hereinbelow. In the fixing step, the paper P on which the unfixed toner image is borne (the unfixed toner image is formed) on the surface by transfer is conveyed to the fixing nip portion Nf of the fixing device 6 along the fixing inlet guide 27. At the fixing nip portion Nf, the unfixed toner image is heated and pressurized to be fixed to the surface of the paper P. The paper P after the toner image is fixed is guided to the paper ejection roller 14 by a paper ejection guide (not shown), and is ejected by the paper ejection roller 14 onto a paper ejection tray 15 on the upper surface of the apparatus main body 100.

Meanwhile, the photosensitive drum 1 after the toner image transfer is charged again by the charging roller 2 and is used for the next image formation. By repeating the above operation, images can be formed one after another.

Fixing Unit

Figure 2:
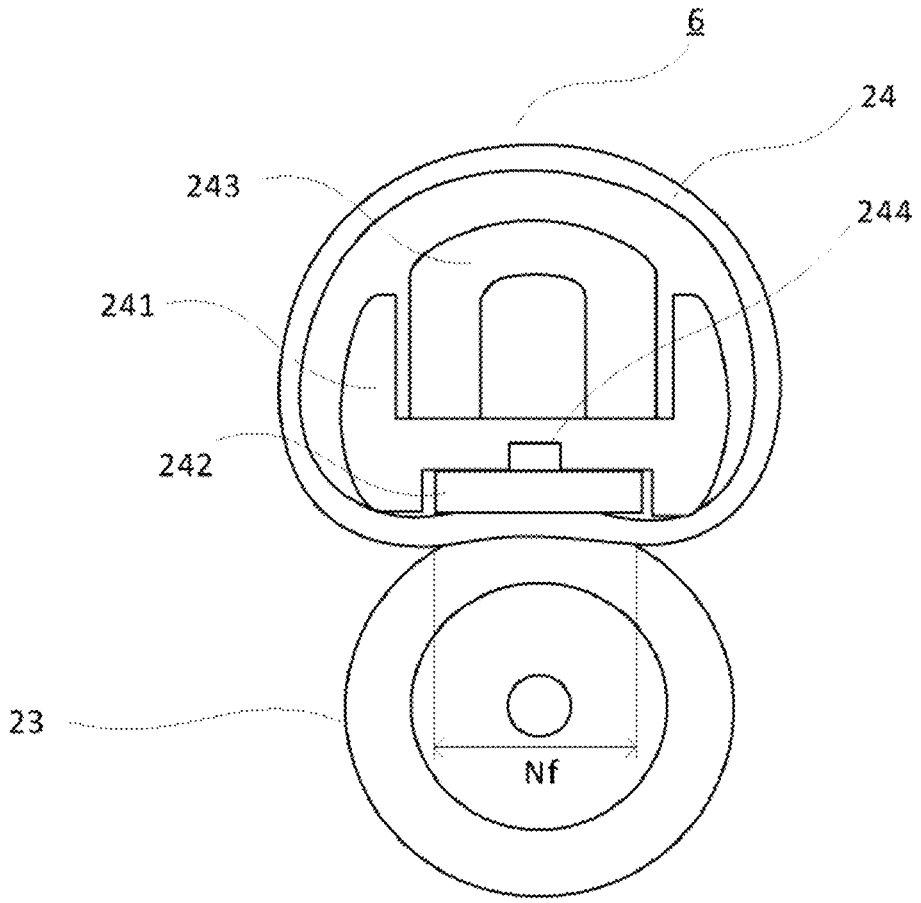
FIG. 2 is a schematic cross-sectional view of a fixing device.

The fixing unit (fixing device) 6 shown in FIGS. 1 and 2 is a film heating type fixing device for the purpose of shortening the start-up time and reducing power consumption.

The cylindrical fixing film 24 as a rotating body is a flexible and rotatable endless belt. The shape of the fixing film is not limited to the cylindrical shape, and can be designed as appropriate. A ceramic heater 242 as a heating member, a heater holder 241 as a holding member for holding the ceramic heater 242, an iron stay 243, and a temperature detection element 244 are provided in the internal space of the fixing film 24. The heating member is not limited to the ceramic heater, and a known heating member can be used. Further, the stay is not limited to the one made of iron, and a known stay can be used.

Further, the fixing unit has a pressure member (pressure roller). The pressure member forms a fixing nip portion together with the heating member with the fixing film being interposed therebetween. In the fixing unit 6 shown in FIGS. 1 and 2, a pressure roller 23 as the pressure member is driven by a drive source, and the fixing film 24 receives power from the pressure roller 23 and is driven rotationally at the fixing nip portion Nf. The heat of the ceramic heater 242 is transferred from the inner surface of the fixing film 24 to the surface, and the surface of the pressure roller 23 is also heated by the fixing nip portion Nf.

As described above, when the paper P onto which the unfixed toner image is transferred is conveyed to the fixing nip portion Nf, the heat of the fixing film 24 and the pressure roller 23 is transferred to the unfixed toner image and the paper P, and the toner image is fixed on the paper P.

The fixing film preferably has a two-layer structure consisting of a base layer and a surface layer.

The base layer is not particularly limited, but preferably comprises a polyimide resin, and is preferably a polyimide resin. The base layer preferably comprises a carbon-based filler in order to improve thermal conductivity and strength as long as the effects of the present disclosure are not impaired.

The amount of the polyimide resin in the base layer is preferably at least 50% by mass.

The surface layer is not particularly limited, but preferably comprises a fluororesin. Among the fluororesins, a fluororesin preferably comprises a perfluoroalkoxy resin (PFA) that excels in mold releasability and heat resistance, and even more preferably is PFA. The amount of the fluororesin (preferably PFA) in the surface layer is preferably at least 50% by mass.

From the viewpoint of thermal conductivity to the heating member and durability of the fixing film, the base layer is preferably from 40 μm to 200 μm. From the same viewpoint, the surface layer is preferably from 3 μm to 40 μm.

In the fixing film 24 shown in FIG. 2 and used in the examples of the first embodiment, a polyimide resin having a thickness of 50 μm and comprising a carbon-based tiller was used as the base layer, and a PFA having a thickness of 10 μm was used as the surface layer. The outer diameter of the fixing film 24 was Φ18 mm, and the width in the longitudinal direction was 220 mm correspondingly to the letter size. The outer diameter and the width in the longitudinal direction of the fixing film can be changed, as appropriate, according to the size of the recording material used.

A heater prepared by coating an energization heat-generating resistance layer of Ag/Pd (silver-palladium) on an alumina base plate surface having a rectangular shape with the width of 6 mm in the recording material conveying direction and a width of 270 mm in the longitudinal direction and also having a thickness of 1 mm, and then coating glass as a heating element protective layer was used as the ceramic heater 242. The width of the energization heat-generating resistance layer in the longitudinal direction was set to 218 mm, which is 1 mm longer on each side than the letter size so that the width 216 mm in the longitudinal direction of the letter size could be sufficiently heated. The dimensions and material of the heating member can be changed as appropriate.

In addition, the presence or absence of the energization heat-generating resistance layer and the material thereof can be changed as appropriate. Further, the heating element protective layer and material thereof can be changed as appropriate.

The fixing device may be provided with a temperature detection element. In FIG. 2, a temperature detection element 244 for detecting the temperature of the ceramic substrate that is heated by the heat generated by the energization heat-generating resistance layer is arranged on the back surface of the ceramic heater 242. The temperature of the ceramic heater 242 is adjusted by controlling, as appropriate, the current flowing from the electrode portion (not shown) at the end in the longitudinal direction to the energization heat-generating resistance layer in response to the signal of the temperature detection element 244.

In the example of the first embodiment, the temperature detection element 244 was adjusted to detect 180° C. while the paper P was passing through the fixing nip portion Nf. At this time, the temperature of the surface of the fixing film 24 was about 150° C.

The temperature of the surface of the fixing film when the recording material was nipped and conveyed by the fixing nip portion was measured as follows.

The temperature of the surface of the fixing film when the recording material was continuously nipped and conveyed at a temperature control temperature of 180° C. in the fixing nip portion was measured using a thermopile TMH91-L500 manufactured by Japan Sensor Co., Ltd. The measurement position was on the upstream side of the fixing nip portion in the conveying direction of the recording material, near the center in the longitudinal direction. The average value of the temperature measured while the recording material was passing through the fixing nip portion and the temperature measured before the continuously conveyed recording material entered the fixing nip portion was taken as the temperature of the surface of the fixing film when the recording material was nipped and conveyed by the fixing nip portion. In this example, the temperature of the surface of the fixing film when the paper was nipped and conveyed by the fixing nip portion measured by the above method was 150° C.

It is preferable that the fixing device be provided with a holding member for holding the heating member. It is more preferable that the holding member be reinforced by a stay or the like.

In FIG. 2, the heater holder 241 is a holding member that holds the ceramic heater 242. The material of the heater holder 241 preferably has a low heat capacity (for example, a liquid crystal polymer) so as not to take heat from the ceramic heater 242, but the material is not limited thereto.

In the example of the first embodiment, a heater holder made of a liquid crystal polymer which is a heat-resistant resin was used. The heater holder 241 made of liquid crystal polymer was reinforced by a stay 243 made of iron from the surface opposite to the holding surface of the ceramic heater 242.

The pressure roller 23 of the example of the first embodiment has an elastic layer (foam rubber) having a width of 220 mm in the longitudinal direction, an outer diameter of Φ14 mm, and a thickness of 2.5 mm in which silicone rubber is foamed on an iron core metal of Φ9 mm. On the elastic layer of the pressure roller 23, a release surface layer made of PFA is formed as a release layer of toner. The surface hardness of the pressure roller 23 comprising the release surface layer measured by an Asker-CSC2 hardness tester was 83°. This form of the pressure member is not limiting, and the design can be changed as appropriate.

The pressure force of the ceramic heater 242 on the pressure roller 23 in the example of the first embodiment was 14 kgf. The heater holder 241 of the example of the first embodiment is formed to have a curved cross section having a convex shape in the same direction as the direction in which the pressure roller flexes smoothly from both ends in the longitudinal direction to the central portion in the longitudinal direction. As a result, the width of the fixing nip portion Nf in the conveying direction becomes uniform in the longitudinal direction, and deterioration of fixing quality is prevented.

In the example of the first embodiment, the width of the fixing nip portion Nf in the conveying direction is 5 mm. The fixing nip width was measured using a pressure distribution measurement system PINCH manufactured by Nitta Corporation, and the width in the paper conveying direction in the region where the pressing force was detected was defined as the fixing nip width. The average pressure applied to the paper by the fixing nip portion Nf was also measured using the pressure distribution measurement system PINCH manufactured by Nitta Corporation.

Assuming that the average pressure applied to the paper by the fixing nip portion Nf is 14 kgf, the fixing nip width is 5 mm, and the longitudinal width of the pressure roller is 220 mm, the contact pressure between the pressure member and the fixing film is 0.120 MPa. The contact pressure between the pressure member and the fixing film, which is applied to the paper by the fixing nip portion Nf, is also hereinafter referred to as a fixing nip pressure σ. The fixing nip pressure σ can be adjusted, as appropriate, by changing the pressing force on the pressure member, the fixing nip width, and the longitudinal width of the pressure member.

Further, a pressure can be applied to the pressure member of the heating member by, for example, urging with a spring.

Assuming that the storage elastic modulus of the toner at the temperature of the surface of the fixing film when the recording material is nipped and conveyed by the fixing nip portion is G (MPa, also referred to as the viscoelasticity G of the toner), the fixing nip pressure σ and the toner viscoelasticity G (MPa) satisfy the following formulas (3) and (4).

$$G \geq 0.060 \text{ MPa} \quad (3)$$

$$G \geq \sigma \times 0.6 \quad (4)$$

Further, where the storage elastic modulus of the toner is denoted by G' (MPa, also referred to as the viscoelasticity G' of the toner), the fixing nip pressure σ and G' satisfy the following formulas (3') and (4').

$$G' \geq 0.060 \text{ MPa} \quad (3')$$

$$G' \geq \sigma \times 0.6 \quad (4')$$

The storage elastic modulus G' can be the storage elastic modulus of the toner at 150° C.

The inventors of the present invention have experimentally found that by satisfying the above formulas (3) and (4), or by satisfying the above formulas (3') and (4'), a low-gloss output image can be obtained and the readability of characters is improved. The experimental results and details of the first embodiment will be summarized hereinbelow.

In the toner on the recording material P after passing through the fixing device 6, a shape retention ratio of the toner present on the outermost surface (hereinafter, also simply referred to as "shape retention ratio of the toner") is preferably at least 60%, and more preferably at least 70%. The toner shape retention ratio may be not more than 90%.

When the shape retention ratio of the toner is within the above range, it becomes easy to obtain an output image with low gloss. The shape retention ratio of the toner can be controlled by changing the viscoelasticity G and G' of the toner and the fixing nip pressure σ, or by changing the production conditions of the toner particles. A method for measuring the shape retention ratio of toner will be described later.

Toner

Figure 3:
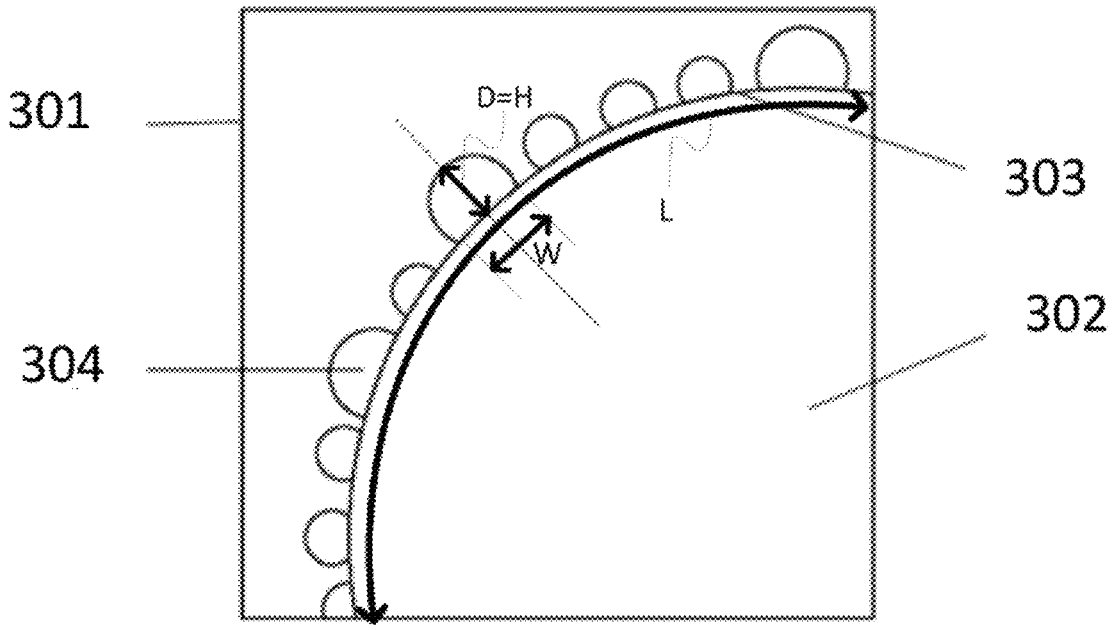
FIG. 3 is a schematic view of an image obtained by cross-sectional observation of toner with STEM.

The toner of the present disclosure will be described hereinbelow. The toner comprises an organosilicon polymer having a structure (T3 unit structure) represented by the following formula (1) on the toner particle surface. FIG. 3 is a schematic view of an image obtained by observing a cross section of the toner with a scanning transmission electron microscope (hereinafter, also referred to as STEM). The detailed STEM observation method will be described hereinbelow.

$$R—SiO_{3/2} \quad (1)$$

In the formula (1), R is an alkyl group having from 1 to 6 carbon atoms or a phenyl group.

The organosilicon polymer has convex portions 304 formed on an outer surface 303 of the toner particle, and where a contour line of the toner base particle in a cross-sectional image 301 of the toner particle obtained by STEM is straightened to a straight line to obtain a straightened image of the cross-sectional image, assuming that in the straightened image, the length of the straight line is L, the length of a line segment of a portion constituting a boundary of the convex portion 304 and the toner base particle 302 in the straight line is a convex portion width W, the maximum length of the convex portion 304 in the normal direction of the convex portion width W is taken as a convex portion diameter D, and the length from an apex of the convex portion 304 in the line segment forming the convex portion diameter D is taken as a convex portion height H, $$\text{the convex portion diameter } D = \text{the convex portion height } H \quad (2).$$

Further, in the toner, the convex portions 304 comprise "specific-height convex portions" having a convex portion height H of from 40 nm to 300 nm.

Among the specific-height convex portions, it is preferable that a number proportion P (D/W) of specific-height convex portions having a ratio D/W of the convex portion diameter D to the convex portion width W of from 0.33 to 0.80 be at least 70% by number.

The above requirements will be explained in detail below.

The toner comprises a toner particle having a toner base particle and an organosilicon polymer on the surface of the toner base particle. The organosilicon polymer has a structure represented by the following formula (1).

$$R—SiO_{3/2} \quad (1)$$

In the structure represented by the formula (1), R is preferably an alkyl group having from 1 to 6 carbon atoms and more preferably an alkyl group having from 1 to 3 carbon atoms.

The alkyl group having from 1 to 3 carbon atoms can be preferably exemplified by a methyl group, an ethyl group and a propyl group. More preferably. R is a methyl group.

Figure 4:
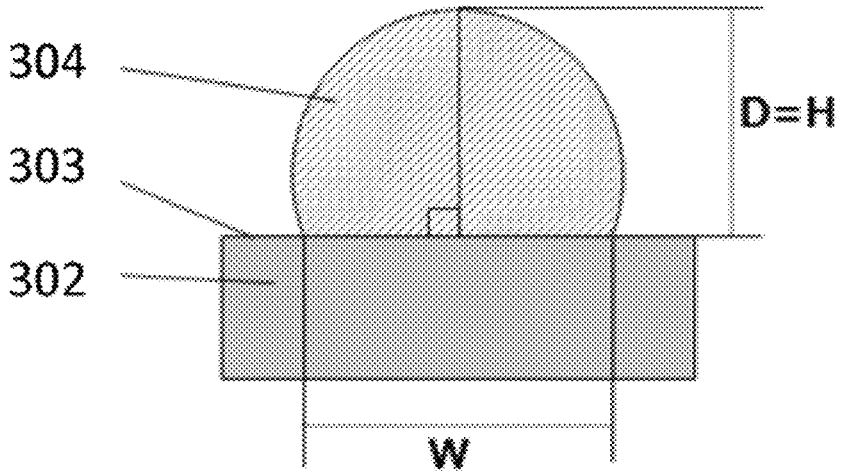
FIG. 4 is a schematic cross-sectional view of a convex portion of an organosilicon polymer.

FIG. 4 is a schematic cross-sectional view of the convex portion 304 of the organosilicon polymer formed on the outer surface 303 of the toner particle of the present disclosure. The organosilicon polymer is hemispherical and forms convex portions 304 on the outer surface 303 of the toner particle, and the relationship of convex portion diameter D=convex portion height H is satisfied. Details of an example of the method for producing the toner will be described later. For example, such a toner can be obtained by a process of adding a hydrolyzed liquid of an organosilicon compound to the toner base particle-dispersed solution and polymerizing in which the polymerization is performed in a state where the organosilicon compound is in a precipitated state in the vicinity of the toner particle surface.

In the toner obtained by such a production method, the convex portions are in surface contact with the surface of the toner base particles. As a result of such surface contact, even when stress is applied to the convex portions during the development, transfer, and fixing electrophotographic processes, the effect of suppressing the movement, detachment, and embedment of the convex portions 304 can be remarkably expected. Therefore, the convex portions 304 remain on the outer surface of the toner particle after passing through the fixing device, the contact area between the toner and the fixing film can be reduced, and the transfer of the toner to the fixing film can be suppressed.

Figure 5:
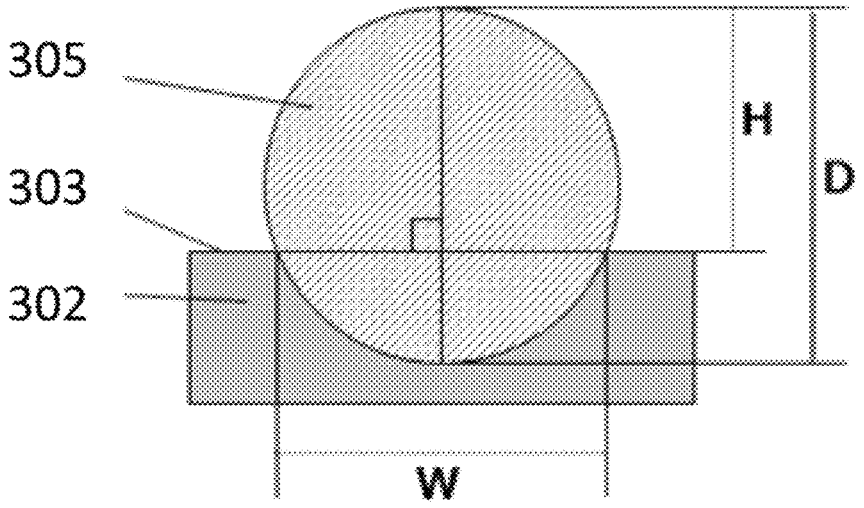
FIG. 5 is a schematic cross-sectional view of a convex portion of a comparative example in which a convex portion diameter D>a convex portion height H.

Meanwhile, FIG. 5 shows a schematic cross-sectional view of the convex portion in which the convex portion diameter D>the convex portion height H as a comparative example. For example, this is the case where a spherical organosilicon polymer 305 is externally added as an external additive for improving flowability, charging performance, and the like, to the outer surface 303 of the toner particle. Where the spherical organosilicon polymer 305 is externally attached to the outer surface of the toner particle, as shown in FIG. 5, the spherical organosilicon polymer 305 may bite into the outer surface 303 of the toner particle while deforming the outer surface, thereby forming a convex state on the surface.

Where the spherical organosilicon polymer 305 is merely externally attached to the outer surface 303 of the toner particle, as described above, that is, where the convex portion diameter D is larger than the convex portion height H (convex portion diameter D>convex portion height h), the toner transfer to the fixing film cannot be suppressed. Where the spherical organosilicon polymer 305 is simply attached to the outer surface 303 of the toner particle, the spherical organosilicon polymer 305 is moved, detached, and embedded during the electrophotographic processes of development, transfer, and fixation. Therefore, the spherical organosilicon polymer 305 does not remain on the outer surface of the toner particles after passing through the fixing device 6.

As a result of studies conducted by the inventors of the present invention to control the shape of the convex portions 304 of the organosilicon polymer as shown in FIG. 4, it has been found that where the organosilicon polymer has a shape such that the ratio D/W of the convex portion diameter D to the width W of the convex portion 304 is from 0.33 to 0.80, the convex portions 304 are less likely to be moved, detached and embedded, which is preferable.

In addition, it has been found that where the number proportion P (D/W) is at least 70% by number, contamination of the fixing film after fixing can be further suppressed.

Where the convex portion height H is at least 40 nm, the convex portions remaining without moving, detaching, or embedment until after fixing protrude sufficiently to reduce the contact area between the fixing film and the image. Meanwhile, when the convex portion height H is not more than 300 nm, the movement, detachment, and embedment, in particular, the detachment, of the convex portions due to external stress is less likely to occur. The detached convex portions may cause contamination of members other than the fixing film.

Therefore, it was understood that where the number proportion P (D/W) is at least 70% by number, it becomes easy to ensure the number of convex portions remaining after fixing without being moved, detached or embedded, so that the effect of suppressing the contamination of the film is better exhibited.

The P (D/W) is more preferably at least 75% by number, and further preferably at least 80% by number. Meanwhile, the upper limit is not particularly limited, but is preferably not more than 95% by number, and more preferably not more than 92% by number.

Also, in the abovementioned straightened image, the ratio (ΣW/L) of the total ΣW of the convex portion width W to the length L of the straight line on the straight line is preferably from 0.30 to 0.90. Where ΣW/L is at least 0.30, a more excellent effect of suppressing the contamination of the fixing film is exerted, and when ΣW/L is not more than 0.90, more excellent low temperature fixability is obtained. The ΣW/L is more preferably from 0.45 to 0.80.

Further, it is preferable that an affixing ratio of the organosilicon polymer to the toner base particle be at least 80% by mass. When the fixing rate is at least 80% by mass, the contamination suppressing effect of the fixing film can be better sustained through durable use.

The affixing ratio is more preferably at least 90% by mass, and even more preferably at least 95% by mass. Meanwhile, the upper limit is not particularly limited, but is preferably not more than 100% by mass, and more preferably not more than 99% by mass.

These affixing ratio and ΣW/L can be controlled by the method for producing an organosilicon polymer described hereinbelow, specifically, by the hydrolysis temperature, the number of loads of alkoxysilane used as a raw material, the pH at the time of hydrolysis and polymerization, and the like.

Further, assuming that a cumulative distribution of the convex portion height H is taken in the "specific height convex portions" where the convex portion height H is from 40 nm to 300 nm, and the convex portion height corresponding to 80% by number as integrated from the smaller convex portion height H is H80, from the viewpoint of improving the fixing film contamination suppression effect, the H80 is preferably at least 65 nm. The H80 is more preferably at least 75 nm, and further preferably at least 80 nm.

The upper limit is not particularly limited, but is preferably not more than 130 nm, more preferably not more than 120 nm, and further preferably not more than 100 nm.

Assuming that when a maximum diameter of the convex portion of the organosilicon polymer in observation of the toner with a scanning electron microscope (hereinafter, also referred to as SEM) is a convex portion diameter R, the number average diameter of the convex portion diameter R is preferably from 20 nm to 80 nm. More preferably, it is from 35 nm to 60 nm.

The organosilicon polymer is preferably a polycondensation polymer of an organosilicon compound having a structure represented by the following formula (Z).

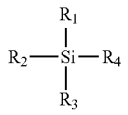

(Z)

In the formula (Z), $R_1$ represents a hydrocarbon group having from 1 to 6 carbon atoms (preferably an alkyl group), and $R_2$, $R_3$ and $R_4$ independently represent a halogen atom, a hydroxy group, an acetoxy groups, or an alkoxy group.

$R_1$ is preferably an aliphatic hydrocarbon group having from 1 to 3 carbon atoms, and more preferably a methyl group.

$R_2$, $R_3$ and $R_4$ are independently a halogen atom, a hydroxy group, an acetoxy group, or an alkoxy group (hereinafter, also referred to as reactive groups). These reactive groups are hydrolyzed, addition polymerized and polycondensed to form a crosslinked structure.

From the viewpoint of mild hydrolysis property at room temperature and the precipitation property on the surface of the toner base particle, an alkoxy group having from 1 to 3 carbon atoms is preferable, and a methoxy group or an ethoxy group is more preferable.

Further, the hydrolysis, addition polymerization and condensation polymerization of $R_2$, $R_3$ and $R_4$ can be controlled by the reaction temperature, reaction time, reaction solvent and pH. In order to obtain an organosilicon polymer, organosilicon compounds having three reactive groups ($R_2$, $R_3$ and $R_4$) in one molecule, excluding $R_1$ in the above formula (Z) (hereinafter, also referred to as trifunctional silane), may be used alone or in combination of two or more.

Examples of the compound represented by the above formula (Z) include the following.

Trifunctional methylsilanes such as methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, and methyldiethoxyhydroxysilane.

Trifunctional silanes such as ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, butyltrihydroxysilane, hexyltrimethoxysilane, hexyltriethoxysilane, hexyltrichlorosilane, hexytriacetoxysilane, and hexyltrihydroxysilane.

Trifunctional phenylsilanes such as phenyltrimethoxysilane, phenyltriethoxysilane, phenyltrichlorosilane, phenyltriacetoxysilane, and phenyltrihydroxysilane.

Further, an organosilicon polymer obtained by using the following compound in combination with an organosilicon compound having a structure represented by the formula (Z) may be used to the extent that the effect of the present disclosure is not impaired. An organosilicon compound having four reactive groups in one molecule (tetrafunctional silane), organosilicon compound having two reactive groups in one molecule (bifunctional silane), and organosilicon compound having one reactive group (monofunctional silane). For example, the following compounds can be mentioned.

Trifunctional vinylsilanes such as dimethyldiethoxysilane, tetraethoxysilane, hexamethyldisilazane, 3-aminopropyltrimethoxysilane, 3-aminopropyltrimethoxysilane, 3-(2-aminoethyl)aminopropyltrimethoxysilane, 3-(2-aminoethyl) aminopropyltriethoxysilane, vinyltriisocyanatosilane, vinyltrimethoxysilane, vinyltriethoxysilane, vinyldiethoxymethoxysilane, vinylethoxydimethoxysilane, vinylethoxydihydroxysilane, vinyldimethoxyhydroxysilane, vinylethoxymethoxyhydroxysilane, and vinyldiethoxyhydroxysilane.

Further, the amount of the organosilicon polymer in the toner particle is preferably from 1.0% by mass to 10.0% by mass, and more preferably from 2.5% by mass to 6.0% by mass.

As a preferable method for forming the specific convex portions on the outer surface of the toner particle, the toner base particles are dispersed in an aqueous medium to obtain a toner base particle-dispersed solution, and an organosilicon compound is added to form the convex portions and obtain a toner particle-dispersed solution.

It is preferable to adjust the solid component concentration of the toner base particle-dispersed solution to from 25% by mass to 50% by mass. The temperature of the toner base particle-dispersed solution is preferably adjusted to at least 35° C. Further, it is preferable to adjust the pH of the toner base particle-dispersed solution to a pH at which the condensation of the organosilicon compound is unlikely to proceed. Since the pH at which the condensation of the organosilicon polymer is unlikely to proceed differs depending on the substance, the pH at which the reaction is most unlikely to proceed is preferably within 0.5.

Meanwhile, it is preferable to use an organosilicon compound that has been hydrolyzed. For example, hydrolysis is performed in a separate container as a pretreatment for the organosilicon compound. Regarding the charge concentration in hydrolysis, where the amount of the organosilicon compound is 100 parts by mass, the amount of water from which ions have been removed such as ion exchange water and RO water is preferably from 40 parts by mass to 500 parts by mass, and more preferably from 100 parts by mass to 400 parts by mass. The hydrolysis conditions are preferably a pH of from 2 to 7, a temperature of from 15° C. to 80° C., and a time of from 30 min to 600 min.

The obtained hydrolyzed liquid and the toner base particle-dispersed solution are mixed to adjust to a pH suitable for condensation (preferably from 1 to 3 or from 6 to 12, more preferably from 8 to 12). The convex portions can be easily formed by adjusting the amount of the hydrolyzed liquid to from 5.0 parts by mass to 30.0 parts by mass of the organosilicon compound with respect to 100 parts by mass of the toner base particles. The temperature and time for forming and condensing the convex portions are preferably maintained at from 35° C. to 99° C. for from 60 min to 72 h.

Further, in controlling the convex portions of the outer surface of the toner particles, it is preferable to adjust the pH in two steps. By adjusting, as appropriate, the holding time before adjusting the pH and the holding time before adjusting the pH in the second step and condensing the organosilicon compound, the convex portions on the outer surface of the toner particle can be controlled. For example, it is preferable to hold the mixture at pH from 4.0 to 6.0 for 0.5 h to 1.5 h and then at pH from 8.0 to 11.0 for from 3.0 h to 5.0 h. The convex portions can also be controlled by adjusting the condensation temperature of the organosilicon compound in the range of from 35° C. to 80° C.

For example, the convex portion width W can be controlled by the addition amount of the organosilicon compound, the reaction temperature, the reaction pH or the reaction time in the first step, and the like. For example, the longer the reaction time in the first stage, the larger the convex portion width tends to be.

Further, the convex portion diameter D and the convex portion height H can be controlled by the hydrolysis temperature of the organosilicon compound, the addition amount of the organosilicon polymer, the reaction temperature, the pH of the second step, and the like. For example, when the hydrolysis temperature is high, the convex portion height H tends to be large. Further, when the reaction pH in the second step is high the convex portion diameter D and the convex portion height H tend to be large.

From the viewpoint of obtaining the effect of suppressing the contamination of the fixing film, the viscoelasticity G of the toner measured by the method described hereinbelow is at least 0.060 MPa. The higher the viscoelasticity G, that is, the harder the toner, the more the movement, detachment, and embedment, in particular the embedment, of the convex portions, which can be generated by the stress applied in the electrophotographic processes of development, transfer, and fixing, are suppressed. Therefore, where the viscoelasticity G is at least 0.060 MPa, the state in which the convex portions 304 remain on the outer surface of the toner particles on the fixed image can be more prominently maintained, the contact area between the toner on the fixed image and the fixed image can be maintained, and the transfer of the toner to the fixing film can be suppressed.

The viscoelasticity G preferably satisfies $G \geq 0.070$ MPa, and more preferably $G \geq 0.080$ MPa. The viscoelasticity G preferably satisfies $10.0 \text{ MPa} \geq G$, and more preferably $1.0 \text{ MPa} \geq G$.

Further, the viscoelasticity G preferably satisfies $G>0.6\times\sigma$, and more preferably $G\geq0.7\times\sigma$. The viscoelasticity G preferably satisfies $10.0\times\sigma\geq G$, and more preferably $1.0\times\sigma\geq G$.

From the viewpoint of obtaining the effect of suppressing the contamination of the fixing film, the viscoelasticity G' of the toner measured by the method described hereinbelow is at least 0.060 MPa. The higher the viscoelasticity G', that is, the harder the toner, the more the movement, detachment, and embedment, in particular the embedment, of the convex portions, which can be generated by the stress applied in the electrophotographic processes of development, transfer, and fixing, are suppressed. Therefore, where the viscoelasticity G' is at least 0.060 MPa, the state in which the convex portions 304 remain on the outer surface of the toner particles on the fixed image can be more prominently maintained, the contact area between the toner on the fixed image and the fixed image can be maintained, and the transfer of the toner to the fixing film can be suppressed.

The viscoelasticity G' preferably satisfies $G'\geq0.070$ MPa, and more preferably $G'\geq0.080$ MPa. The viscoelasticity G' preferably satisfies $10.0\ \text{MPa}\geq G'$, and more preferably $1.0\ \text{MPa}\geq G'$.

Further, the viscoelasticity G' preferably satisfies $G'>0.6\times\sigma$, and more preferably $G'\geq0.7\times\sigma$. The viscoelasticity G' preferably satisfies $10.0\times\sigma\geq G'$, and more preferably $1.0\times\sigma\geq G'$.

The specific method for producing the toner will be described hereinbelow, but this method is not limiting.

It is preferable that the toner base particles are produced in an aqueous medium and that convex portions comprising an organosilicon polymer are formed on the surface of the toner base particle.

As a method for producing the toner base particles, a suspension polymerization method, a dissolution suspension method, and an emulsion aggregation method are preferable, and the suspension polymerization method is more preferable. In the suspension polymerization method, the organosilicon polymer is likely to be uniformly deposited on the surface of the toner base particle, and the contact area with the fixing film is likely to be reduced due to the convex portions on the fixed image. Hereinafter, the suspension polymerization method will be further described.

In the suspension polymerization method, toner base particles are obtained by granulating a polymerizable monomer composition comprising a polymerizable monomer capable of producing a binder resin and, if necessary, an additive such as a colorant in an aqueous medium, and polymerizing the polymerizable monomer contained in the polymerizable monomer composition.

A mold release agent and other resins may be added to the polymerizable monomer composition, if necessary. Further, after completion of the polymerization step, the produced particles can be recovered by washing and filtration by a known method and dried. The temperature may be raised in the latter half of the polymerization step. Further, in order to remove the unreacted polymerizable monomer or by-product, it is also possible to distill off a part of the dispersion medium from the reaction system in the latter half of the polymerization step or after completion of the polymerization step.

It is preferable to use the toner base particles thus obtained to form convex portions of the organosilicon polymer by the above-described method.

A release agent may be used in the toner. Examples of the release agent include the following.

Petroleum waxes and derivatives thereof such as paraffin wax, microcrystalline wax and petrolatum, montan wax and derivatives thereof, hydrocarbon waxes obtained by the Fisher Tropsch method and derivatives thereof, polyolefin waxes such as polyethylene and polypropylene and derivatives thereof, natural waxes such as carnauba wax and candelilla waxes and derivatives thereof, higher aliphatic alcohols, fatty acids such as stearic acids and palmitic acids, or amides, esters or ketones of such acids, hardened castor oil and derivatives thereof, vegetable waxes, animal waxes, silicone resins.

The derivatives include oxides, block copolymers with vinyl-based monomers, and graft-modified products. The release agents may be used alone or in combination of two or more.

The amount of the release agent is preferably from 2.0 parts by mass to 30.0 parts by mass with respect to 100 parts by mass of the binder resin or the polymerizable monomer that produces the binder resin.

As other resins, for example, the following resins can be used.

Homopolymer of styrene and substituents thereof such as polystyrene and polyvinyltoluene; styrene copolymers such as styrene-propylene copolymer, styrene-vinyl toluene copolymer, styrene-vinyl naphthalin copolymer, styrene-methyl acrylate, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymer; polymethyl methacrylate, polybutyl methacrylate, polyvinyl acetate, polyethylene, polypropylene, polyvinyl butyral, silicone resin, polyester resin, polyamide resin, epoxy resin, polyacrylic resin, rosin, modified rosin, terpene resin, phenol resin, aliphatic or alicyclic hydrocarbon resin, and aromatic petroleum resin. These may be used alone or in combination of two or more.

As the polymerizable monomer, vinyl-based polymerizable monomer shown below can be preferably exemplified.

Styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; methacrylic polymerizable monomers such as methyl methacrylate, ethyl methacrylate, n-propy methacrylate, iso-propy methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; methylene aliphatic monocarboxylic acid esters; vinyl esters such as vinyl acetate, vinyl propionate, vinyl benzoate, vinyl butyrate, and vinyl formate; vinyl ethers such as vinyl methyl ether, vinyl ethyl ether, and vinyl isobutyl ether; vinyl methyl ketone, vinyl hexyl ketone, and vinyl isopropyl ketone.

Among these vinyl monomers, styrene, styrene derivatives, acrylic polymerizable monomers and methacrylic polymerizable monomers are preferable.

Further, a polymerization initiator may be added when polymerizing the polymerizable monomers. Examples of the polymerization initiator include the following.

Azo-based or diazo-based polymerization initiators such as 2,2'-azobis-(2,4-divaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile; and peroxide-based polymerization initiators such as benzoyl peroxide, methyl ethyl ketone peroxide, diisopropyloxy carbonate, cumene hydroperoxide, 2,4-dichlorobenzoyl peroxide and lauroyl peroxide.

The addition amount of these polymerization initiator added is preferably from 0.5 parts by mass to 30.0 parts by mass with respect to 100 parts by mass of the polymerizable monomers, and the polymerization initiators may be used alone or in combination of two or more.

Further, in order to control the molecular weight of the binder resin constituting the toner base particle, a chain transfer agent may be added when the polymerizable monomer is polymerized. The preferable addition amount is from 0.001 parts by mass to 15.000 parts by mass with respect to 100 parts by mass of the polymerizable monomer.

Meanwhile, in order to control the molecular weight of the binder resin constituting the toner base particles, a crosslinking agent may be added during the polymerization of the polymerizable monomer. For example, the following crosslinking agents can be mentioned.

Divinylbenzene, bis (4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycols #200, #400, and #600, dipropylene glycol diacrylate, polypropylene glycol diacrylate, polyester type diacrylate (MANDA, Nippon Kayaku K.K.), and the above acrylates changed to methacrylates.

Examples of the polyfunctional crosslinkable monomers include the following. Pentaerythritol triacrylate, trimethylolethane triacrylate, trimethylolpropane triacrylate, tetramethylolmethane tetraacrylate, oligoester acrylates and corresponding methacrylates, 2,2-bis(4-methacryloxy-polyethoxyphenyl) propane, diacryl phthalate, triallyl cyanurate, triallyl isocyanurate, triallyl trimellitate, diallyl chlorendate.

The preferable addition amount is from 0.001 parts by mass to 15.000 parts by mass with respect to 100 parts by mass of the polymerizable monomers.

When the medium used in the suspension polymerization is an aqueous medium, the following can be used as a dispersion stabilizer for the particles of the polymerizable monomer composition.

Tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina.

Further, examples of organic dispersants include the following. Polyvinyl alcohol, gelatin, methyl cellulose, methyl hydroxypropyl cellulose, ethyl cellulose, sodium salt of carboxymethyl cellulose, and starch.

It is also possible to use commercially available nonionic, anionic and cationic surfactants. Examples of such surfactants include the following. Sodium dodecyl sulfate, sodium tetradecyl sulfate, sodium pentadecyl sulfate, sodium octyl sulfate, sodium oleate, sodium laurate, and potassium stearate.

A colorant may be used in the toner, and known colorants can be used without particular limitation.

The amount of the colorant is preferably from 3.0 parts by mass to 15.0 parts by mass with respect to 100 parts by mass of the binder resin or the polymerizable monomer.

A charge control agent can be used during toner production, and known charge control agents can be used. The addition amount of the charge control agent is preferably from 0.01 parts by mass to 10.00 parts by mass with respect to 100 parts by mass of the binder resin or the polymerizable monomer.

The toner particles may be used as they are as the toner, or various organic or inorganic fine powders may be externally added to the toner particles, if necessary. When the organic or inorganic fine powder is added, from the viewpoint of durability, it is preferable that the particle diameter thereof be not more than 1/10 of the weight average particle diameter of the toner particles.

As the organic or inorganic fine powder, for example, the following is used.

(1) Flowability imparting agent: silica, alumina, titanium oxide, carbon black and carbon fluoride.

(2) Abrasive: metal oxides (for example, strontium titanate, cerium oxide, alumina, magnesium oxide, and chromium oxide), nitrides (for example, silicon nitride), carbides (for example, silicon carbide), metal salts (for example, calcium sulfate, barium sulfate, and calcium carbonate).

(3) Lubricating agent: fluororesin powder (for example, vinylidene fluoride and polytetrafluoroethylene), fatty acid metal salts (for example, zinc stearate and calcium stearate).

(4) Charge control particles: metal oxides (for example, tin oxide, titanium oxide, zinc oxide, silica, and alumina) and carbon black.

Surface treatment of the organic or inorganic fine powder may be performed to improve the flowability of the toner and charge uniformity of the toner. Examples of the treatment agent for hydrophobizing the organic or inorganic fine powder include unmodified silicone varnish, various modified silicone varnishes, unmodified silicone oil, various modified silicone oils, silane compounds, silane coupling agents, other organosilicon compounds, and organotitanium compounds. These treatment agents may be used alone or in combination of two or more.

Various Measurement Methods

Methods for measuring various physical properties will be described below.

Method for Calculating Toner Shape Retention Ratio

The shape retention ratio of toner is measured as follows.

An outputted solid black image is observed using a scanning electron microscope S-4800 of Hitachi High-Technologies Corporation. As the paper, Xerox Vitality Multipurpose Printer Paper (trade name, basis weight 75 g) manufactured by Xerox Co., Ltd. is used.

(1) Sample Preparation

A conductive paste (TED PELLA, Inc, Product No. 16053, PELCO Colloidal Graphite, Isopropanol base) is thinly applied to a sample table (aluminum sample table 15 mm×6 mm), and regions at the leading end of the paper and in the central portion in the width direction of the outputted solid black image are cut into 5 mm squares and placed on the paste. Platinum is vapor-deposited for 15 sec at 15 mA thereon. The sample table is set in a sample holder and the sample table height is adjusted to 30 mm with a sample height gauge.

(2) Observation Condition Setting for S-4800

Liquid nitrogen is injected, until it overflows, into an anti-contamination trap attached to the housing of S-4800, and allowed to stand for 30 min. A PC-SEM of S-4800 is started to perform flushing (cleaning of an FE chip which is an electron source). An accelerating voltage display part of a control panel on a screen is clicked, a [Flushing] button is pushed, and a flushing execution dialog is opened. A flushing intensity of 2 is confirmed and executed. An emission current due to flushing is confirmed to be from 20 μA to 40 μA. The sample holder is inserted into the sample chamber of the S-4800 housing. [Origin] on the control panel is pressed to move the sample holder to the observation position.

The accelerating voltage display is clicked to open an HV setting dialog, the accelerating voltage is set to (2.0 kV and the emission current is set to [10 μA]. In the [Basic] tab of the operation panel, the signal selection is set to [SE] and [Down (L)] is selected for the SE detector to set the mode for observing the reflected electron image. Similarly, in the [Basic] tab of the operation panel, the probe current of an electro-optical system condition block is set to [Normal], the focus mode is set to [UHR], and WD is set to [8.0 mm]. An [ON] button on the acceleration voltage display of the control panel is pushed to apply the acceleration voltage.

(3) Focus Adjustment

The inside of the magnification display section of the control panel is dragged to set the magnification to 5000 (5 k) times. A focus knob [COARSE] on the operation panel is rotated to adjust the aperture alignment when the focus is adjusted to some extent. [Align] on the control panel is clicked to display an alignment dialog, and [Beam] is selected. STIGMA/ALIGNMENT knobs (X, Y) on the operation panel are rotated to move the displayed beam to the center of the concentric circles.

Next, [Aperture] is selected and the STIGMA/ALIGNMENT knobs (X, Y) are rotated one by one to stop the movement of the image or adjust the movement to the minimum. The aperture dialog is closed and focusing is performed by autofocus. This operation is repeated again to focus. With the midpoint of the maximum diameter of the observed particles aligned with the center of the measurement screen, the inside of the magnification display section of the control panel is dragged to set the magnification to 10,000 (10 k) times. The focus knob [COARSE] on the operation panel is rotated to adjust the aperture alignment when the focus is adjusted to some extent. [Align] on the control panel is clicked to display the alignment dialog, and [Beam] is selected. The STIGMA/ALIGNMENT knobs (X, Y) on the operation panel are rotated to move the displayed beam to the center of the concentric circles.

Next, [Aperture] is selected and the STIGMA/ALIGNMENT knobs (X, Y) are rotated one by one to stop the movement of the image or adjust the movement to the minimum. The aperture dialog is closed and focusing is performed by autofocus. After that, the magnification is set to 500 times, the focus is adjusted using the focus knob and the STIGMA/ALIGNMENT knobs in the same manner as above, and the focus is adjusted again by autofocus. This operation is repeated to focus.

(4) Image Storage

The brightness is adjusted in an ABC mode, and an image is captured with a size of 640 pixels×480 pixels and saved.

After performing the operations (2) to (4) by selecting an arbitrary location, the operations (2) to (4) are repeated for eight adjacent surrounding locations to obtain a total of nine images.

From the obtained image, the shape retention ratio of the toner is determined. ImageJ, the image processing software of the National Institutes of Health (available from https://imagej.nih.gov/ij/), is used for the measurement.

The shape of the toner present on the outermost surface of the toner on the recording material before passing through the fixing device is specified by the method described hereinbelow.

The shape of the toner present on the outermost surface of the toner on the recording material after passing through the fixing device is visually specified. In the area of 0.048 $mm^2$ of the observation image of one sheet, a region where the toner melts and spreads and the boundary between adjacent toner particles cannot be seen is determined to be a region where the toner shape is not retained, and the region other than this region is determined to be a region where the shape is retained.

The region where the toner shape is retained is surrounded by a line drawing tool and filled. The area ratio occupied by this filled region is determined by binarization. The average value of nine sheets of the area ratio of the filled region is taken as the shape retention ratio.

Figure 6A:
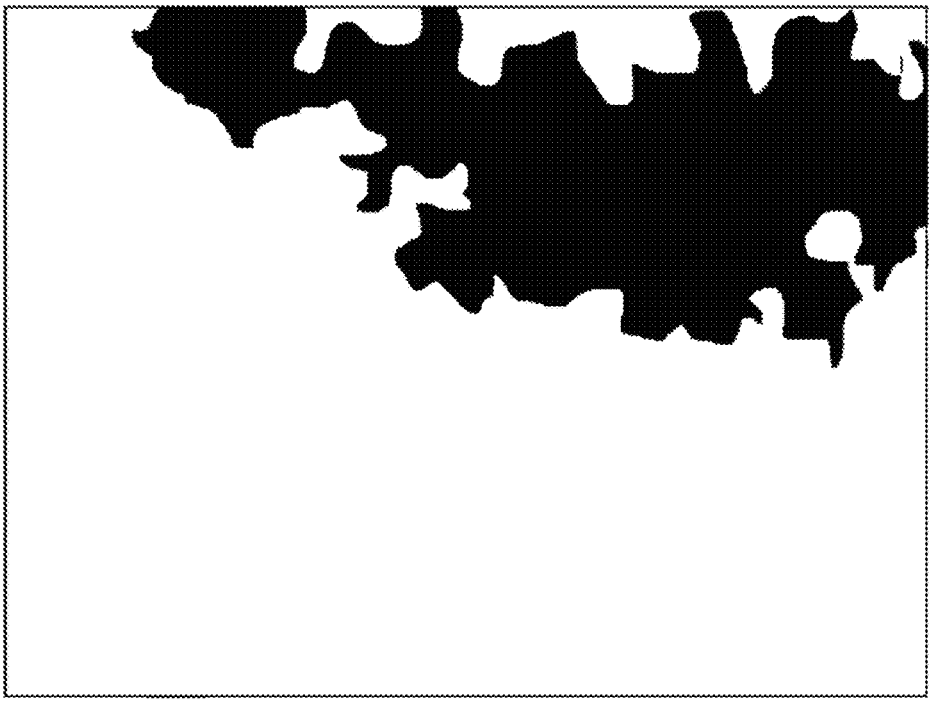
FIG. 6A is an example of an SEM image for determining a shape retention ratio of toner.
Figure 6B:
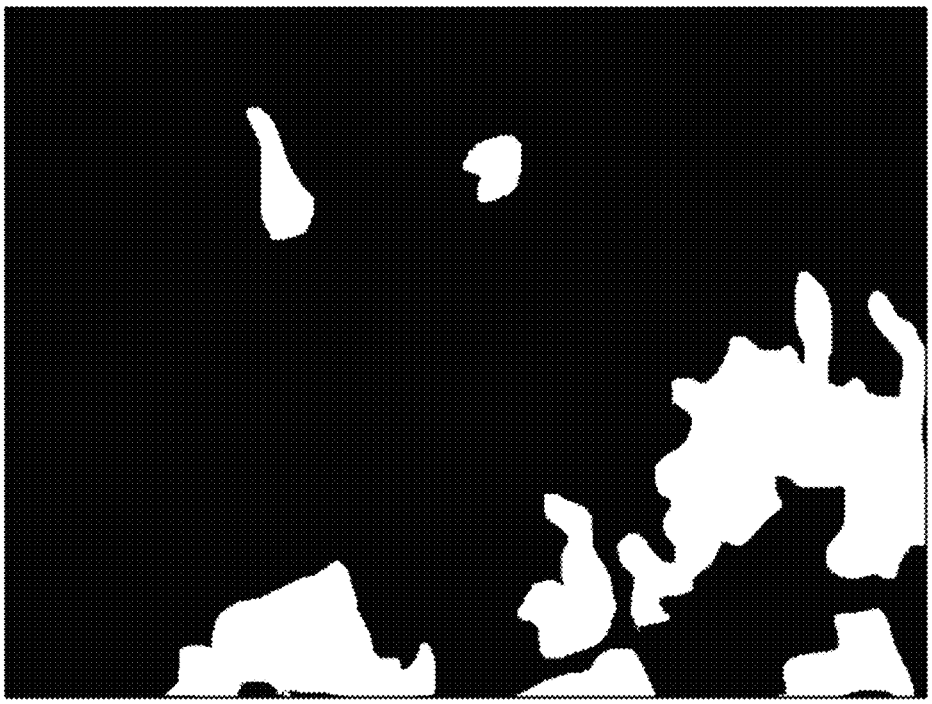
FIG. 6B is an example of an SEM image for determining a shape retention ratio of toner.

An observation image obtained with a toner shape retention ratio of 24.8% is shown in FIG. 6A, and an observation image obtained with a toner shape retention ratio of 84.34% is shown in FIG. 6B.

Means for Specifying Shape of Toner Before Passing Through Fixing Device

Method of Identifying Toner Shape by Scanning Electron Microscope (SEM)

A method of SEM observation is as follows. The observation is performed using images taken by the Hitachi ultra-high resolution field emission scanning electron microscope S-4800 (Hitachi High-Technologies Corporation). The image capturing conditions of S-4800 are as follows.

(1) Sample Preparation

A conductive paste (TED PELLA, Inc, Product No. 16053, PELCO Colloidal Graphite, Isopropanol base) is thinly applied to a sample table (aluminum sample table 15 mm×6 mm), and the toner is sprayed thereon. Air blowing is then performed to remove excess toner from the sample table, and then platinum is vapor-deposited at 15 mA for 15 sec. The sample table is set in a sample holder and the sample table height is adjusted to 30 mm with a sample height gauge.

(2) Observation Condition Setting for S-4800 and (3) Focus Adjustment

The same operations are performed under the conditions shown in (2) Observation Condition Setting for S-4800 and (3) Focus Adjustment of the Method for Calculating Toner Shape Retention Ratio.

(4) Image Storage

The brightness is adjusted in an ABC mode, and an image is captured with a size of 640 pixels×480 pixels and saved.

Method for Observing Cross Section of Toner with Scanning Transmission Electron Microscope (STEM)

The cross section of the toner to be observed with a scanning transmission electron microscope (STEM) is prepared as follows.

The procedure for preparing the cross section of the toner will be described below.

First, the toner is sprayed on a cover glass (Matsunami Glass Co., Ltd., square cover glass; square No. 1) so as to form a single layer, and an osmium plasma coater (filgen Co., Ltd., OPC80T) is used to apply an Os film (5 nm) and a naphthalene film (20 nm) as protective films to the toner.

Next, a PTFE tube (inner diameter Φ1.5 mm×outer diameter Φ3 mm×3 mm) is filled with a photocurable resin D800 (JEOL Ltd.), and the cover glass is quietly placed on the tube in orientation such that the toner makes contact with the photocurable resin D800. After irradiating with light in this state to cure the resin, the cover glass and the tube are removed to form a cylindrical resin in which the toner is embedded on the outermost surface.

A cross section of the central part of the toner is obtained by cutting with an ultrasonic ultramicrotome (Leica Camera AG, UC7) at a cutting speed of 0.6 mm/s through a length of the radius of the toner from the outermost surface of the cylindrical resin (for example, 4.0 μm when the weight average particle diameter (D4) is 8.0 μm).

Next, cutting to a film thickness of 100 nm is performed to prepare a thin sample of the cross section of the toner. By cutting by such a method, a cross section of the toner center portion can be obtained.

An image with an image size of 1024 pixel×1024 pixel is acquired at a STEM probe size of 1 nm. Further, the Contrast of the Ditector Control panel of the bright field image is adjusted to 1425, the Brightness is adjusted to 3750, the Contrast of the image Control panel is adjusted to 0.0, the Brightness is adjusted to 0.5, and the Gamma is adjusted to 1.00 to acquire an image. The image magnification is 100,000 times, and the image is acquired so as to fit in about one-fourth to one-half of the circumference of the cross section in one toner particle as shown in FIG. 3.

The obtained image is analyzed using ImageJ, the image processing software of the National Institutes of Health (available from https://imagej.nih.gov/ij/), and the convex portions comprising the organosilicon polymer are measured. Image analysis is performed on 30 STEM images.

First, a line is drawn along the circumference of the toner base particle with a line drawing tool (Segmented line on the Straight tab is selected). The portions where the convex portions of the organosilicon polymer are embedded in the toner base particle are smoothly connected with the line assuming that there is no embedment so as to maintain the curvature around the toner base particle.

This line is converted to a straight line (Selection is selected on the Edit tab, the line width is converted to 500 pixel in Properties, and then Selection is selected on the Edit tab and Straightener is performed).

As a result, a straightened image in which the contour line of the toner base particle is straightened to a straight line is obtained. In the straightened image, the convex portion width W, the convex portion diameter D, and the convex portion height H are measured for each convex portion comprising the organosilicon polymer.

In the straightened image, the length of the straight line is taken as L. Here, L corresponds to the length of the toner base particle surface in the STEM image. The length of the line segment of the portion constituting the boundary between the convex portion and the toner base particle on the straight line is taken as the convex portion width W. Further, the maximum length of the convex portion in the normal direction of the convex portion width W is taken as the convex portion diameter D, and the length from the apex of the convex portion (the apex on the outer side of the toner particle) to the straight line in the line segment forming the convex portion diameter D is taken as the convex portion height H.

The sum total value of the convex portion widths W of the "specific-height convex portions" in which the height H of the convex portions present in the straightened image used for image analysis is from 40 nm to 300 nm is taken as ΣW. The convex portion diameter D, the convex portion height H and the ΣW/L are calculated from one image, and the arithmetic mean value of 30 STEM images is adopted.

In addition, P (D/w) is calculated from the result of measuring the 30 STEM images. H80 is calculated by taking the cumulative distribution of the convex portion height H.

The detailed measurement of the convex portions is as described above and shown in FIGS. 4 and 5.

The measurement is performed after overlaying the scale on the image in the Image J with the Straight Line of the Straight tab and setting the length of the scale on the image with Set Scale on the Analyze tab. A line segment corresponding to the convex portion width W or the convex portion height H can be drawn with the Straight Line of the Straight tab, and can be measured with the Measure of the Analyze tab.

When the arithmetic mean values of the convex portion diameter D and the convex portion height H obtained above and rounded to the first decimal place (unit: nm) are equal to each other, it is determined that the convex portion diameter D=the convex portion height H.

Method for Calculating Average Particle Diameter (Convex Portion Diameter R) of Convex Portion by Scanning Electron Microscope (SEM)

The method of SEM observation is as follows. The observation is performed using images taken by the Hitachi ultra-high resolution field emission scanning electron microscope S-4800 (Hitachi High-Technologies Corporation). The image capturing conditions of S-4800 are as follows.

(1) Sample Preparation

A conductive paste (TED PELLA, Inc. Product No. 16053, PELCO Colloidal Graphite, Isopropanol base) is thinly applied to a sample table (aluminum sample table 15 mm×6 mm), and the toner is sprayed thereon. Air blowing is then performed to remove excess toner from the sample table, and then platinum is vapor-deposited at 15 mA for 15 sec. The sample table is set in a sample holder and the sample table height is adjusted to 30 mm with a sample height gauge.

(2) Observation Condition Setting for S-4800 and (3) Focus Adjustment

The same operations are performed under the conditions shown in (2) Observation Condition Setting for S-4800 and (3) Focus Adjustment of the Method for Calculating Toner Shape Retention Ratio, except that the operation performing focus adjustment by setting the magnification to 500 times is changed to performing focus adjustment by setting the magnification to 50,000 (50 k).

(4) Image Storage

The brightness is adjusted in an ABC mode, and an image is captured with a size of 640 pixels×480 pixels and saved.

From the obtained SEM image, the number average diameter (D) of 500 convex portions of at least 20 nm that are present on the toner particles surface is calculated using the image processing software ImageJ of the National Institutes of Health. The measurement method is as follows.

Measurement of Number Average Diameter of Convex Portions of Organosilicon Polymer By particle analysis, the convex portions in the image and the toner base particles are color-coded by binarization.

Next, the maximum length of the selected shape is selected from the measurement commands, and the convex portion diameter R (maximum diameter) of one convex portion is measured. By performing this operation a plurality of times and obtaining the arithmetic mean value at 500 points, the number average diameter of the convex portion diameter R is calculated.

Method for Confirming Composition (T3 unit structure) of Organosilicon Polymer

NMR is used to identify the composition of the organosilicon polymer on the toner particles surface.

Where the toner comprises an external additive such as silica fine particles in addition to the organosilicon polymer, the following operations are performed.

A total of 1 g of the toner is placed in a vial, dissolved in 31 g of chloroform, and dispersed. For dispersion, the treatment is performed for 30 min using an ultrasonic homogenizer to prepare a dispersion liquid.

Ultrasonic processing device: ultrasonic homogenizer VP-050 (manufactured by TIETECH Co., Ltd.)

Microchip: step-type microchip, tip diameter Φ2 mm

Microchip tip position: in the central part of glass vial and at a height of 5 mm from the bottom of the vial Ultrasonic conditions: intensity 30%, 30 min At this time, ultrasonic waves are applied while cooling the vial with ice water to prevent the temperature of the dispersion liquid from rising.

The dispersion liquid is transferred to a glass tube (50 mL) for a swing rotor, and centrifugal separation is performed with a centrifuge (H-9R; manufactured by Kokusan Co., Ltd.) under the conditions of 58.33 $S^{-1}$ for 30 min. In the glass tube after the centrifugal separation, the lower layer contains particles having a large specific gravity, for example, silica fine particles. A chloroform solution containing the organosilicon polymer of the upper layer is collected, and the chloroform is removed by vacuum drying (40° C./24 h) to prepare a sample.

Using the sample or toner, the structure such as the T3 unit structure represented by R—$SiO_{3/2}$ in the organosilicon polymer is confirmed by solid $^{29}$Si-NMR.

In solid $^{29}$Si-NMR, peaks are detected in different shift regions depending on the number of functional groups bonded to Si constituting the organosilicon polymer.

The number of functional groups of each peak can be specified using a standard sample. Further, the abundance ratio of each constituent compound can be calculated from the obtained peak area.

The measurement conditions for solid $^{29}$Si-NMR are, for example, as follows.

Equipment: JNM-ECX5002 (JEOL RESONANCE)

Temperature: room temperature

Measurement method: DDMAS method, $^{29}$Si 45°

Sample tube: zirconia 3.2 mmΦ

Sample: filled in a test tube in a powder form

Sample rotation speed: 10 kHz

Relaxation delay: 180 s

Scan: 2000

Further, the hydrocarbon group represented by R is confirmed by $^{13}$C-NMR.

$^{13}$C-NMR (Solid-State) Measurement Conditions

Equipment: JNM-ECX500II, manufactured by JEOL RESONANCE

Sample tube: 3.2 mmΦ

Sample: filled in a test tube in a powder form

Measurement temperature: room temperature

Pulse mode: CP/MAS

Measurement nuclear frequency: 123.25 MHz ($^{13}$C)

Reference substance: adamantane (external standard: 29.5 ppm)

Sample rotation speed: 20 kHz

Contact time: 2 ms

Delay time: 2 s

Accumulation number: 1024 times

By this method, the hydrocarbon group represented by R is confirmed by the presence or absence of a signal caused by a methyl group (Si—$CH_3$), an ethyl group (Si—$C_2H_5$), a propyl group (Si—$C_3H_7$), a butyl group (Si—$C_4H_9$), a pentyl group (Si—$C_5H_{11}$) a hexyl group (Si—$C_6H_{13}$) or a phenyl group (Si—$C_6H_5$) bonded to a silicon atom.

After the measurement, a plurality of silane components having different substituents and bonding groups of the organosilicon polymer are peak-separated into the following X1 structure, X2 structure, X3 structure, and X4 structure by curve fitting, and the respective peak areas are calculated.

The following X3 structure is a T3 unit structure.

X1 structure: $(Ri)(Rj)(Rk)SiO_{1/2}$ (A1)

X2 structure: $(Rg)(Rh)Si(O_{1/2})_2$ (A2)

X3 structure: $RmSi(O_{1/2})_3$ (A3)

X4 structure: $Si(O_{1/2})_4$ (A4)

X1

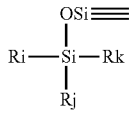

(A1)

X2

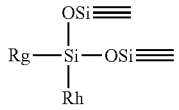

(A2)

X3

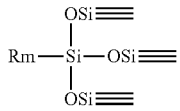

(A3)

X4

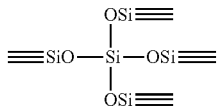

(A4)

Ri, Rj, Rk, Rg, Rh and Rm in the formulas (A1), (A2) and (A3) each represent an organic group such as hydrocarbon group having from 1 to 6 carbon atoms, a halogen atom, a hydroxy group, an acetoxy group or an alkoxy group bonded to silicon.

When it is necessary to confirm the structure in more detail, the identification may be performed by the measurement result of $^{1}$H-NMR together with the measurement result of $^{13}$C-NMR and $^{29}$Si-NMR.

Method for Quantifying Organosilicon Polymer when Toner Comprises External Additive Such as Silica Fine Particles The toner is dispersed in chloroform as described above, and then centrifugal separation is used to separate an organosilicon polymer and an external additive such as silica fine particles by a difference in specific gravity, respective samples are obtained, and the amount of the organosilicon polymer or the external additive such as silica fine particles is obtained.

The case where the external additive is silica fine particles will be illustrated below. Other fine particles can be also quantified by the same method.

First, the pressed toner is measured with fluorescent X-rays, and the amount of silicon in the toner is determined by performing an analysis process such as a calibration line method or an FP method.

Next, the structures of the organosilicon polymer and each constituent compound forming the silica fine particles are specified by using solid $^{29}$Si-NMR and pyrolysis GC/MS, and the amount of silicon in the organosilicon polymer and the silica fine particles is obtained.

From the relationship between the amount of silicon in the toner determined by fluorescent X-ray and the amount of silicon in the organosilicon polymer and silica fine particles determined by solid $^{29}$Si-NMR and thermal decomposition GC/MS, the amount of the organosilicon polymer in the toner is determined.

Method for Measuring Affixing Rate of Organosilicon Polymer to Toner Base Particle A total of 20 g of a 30% by mass of an aqueous solution of CONTAMINON N (a neutral detergent for cleaning precision measuring instruments with a pH of 7 consisting of a nonionic surfactant, an anionic surfactant, and an organic builder) is weighed in a 50 mL capacity vial, and 1 g of the toner is admixed.

The vial is set in "KM Shaker" (model: V. SX) manufactured by Iwaki Sangyo Co., Ltd., the speed is set to 50, and shaking is performed for 120 sec. As a result, depending on the affixing state of the organosilicon polymer or the silica fine particles, the organosilicon polymer or the external additive such as silica fine particles migrates from the toner base particles or the toner particles surface into the dispersion liquid.

Then, the toner and the organosilicon polymer or the external additive such as silica fine particles that has migrated into the supernatant are separated with a centrifuge (H-9R; manufactured by Kokusan Co., Ltd.) (for 5 min at 16.67 $S^{-1}$).

The precipitated toner is dried by vacuum drying (40° C./24 hours), washed with water, and then used as toner.

Next, using the Hitachi ultra-high resolution field emission scanning electron microscope S-4800 (Hitachi High Technologies Corporation.), images of the toner that does not undergo the water washing step (toner before washing with water) and the toner that is obtained through the water washing step (toner after washing with water) are captured.

In addition, the measurement target is identified by elemental analysis using energy dispersive X-ray analysis (EDS).

Then, the captured toner surface image is analyzed using the image analysis software Image-Pro Plus ver. 5.0 (Nippon Roper Co., Ltd.), and a coverage is calculated. The affixing ratio is calculated based on the calculated coverage.

The image capturing conditions of S-4800 are as follows.

(1) Sample Preparation

A conductive paste is thinly applied to a sample table (aluminum sample table 15 mm×6 mm), and the toner is sprayed thereon. Air blowing is then is performed to remove excess toner from the sample table, followed by sufficient drying. The sample table is set in a sample holder and the sample table height is adjusted to 36 mm with a sample height gauge.

(2) Observation Condition Setting for S-4800

When measuring the coverage, elemental analysis is performed in advance by the energy dispersive X-ray analysis (EDS) described above, and the measurement is performed after distinguishing the organosilicon polymer or the external additive such as silica fine particles on the toner surface.

Liquid nitrogen is injected, until it overflows, into an anti-contamination trap attached to the housing of S-4800, and allowed to stand for 30 min. A PC-SEM of S-4800 is started to perform flushing (cleaning of an FE chip which is an electron source). An accelerating voltage display part of a control panel on a screen is clicked, a [Flushing] button is pushed, and a flushing execution dialog is opened. A flushing intensity of 2 is confirmed and executed. An emission current due to flushing is confirmed to be from 20 μA to 40 μA. The sample holder is inserted into the sample chamber of the S-4800 housing. [Origin] on the control panel is pressed to move the sample holder to the observation position.

The accelerating voltage display is clicked to open an HV setting dialog, the accelerating voltage is set to [1.1 kV] and the emission current is set to [20 μA]. In the [Basic] tab of the operation panel, the signal selection is set to [SE] and [Up (U)] and [+BSE] are selected for the SE detector. [L. A. 100] is selected with a selection box to the right of [+BSE] to set the mode for observing with a reflected electron image. Similarly, in the [Basic] tab of the operation panel, the probe current of an electro-optical system condition block is set to [Normal], the focus mode is set to [UHR], and WD is set to [4.5 mm]. An [ON] button on the acceleration voltage display of the control panel is pushed to apply the acceleration voltage.

(3) Calculation of Number Average Particle Diameter (D1) of Toner

The inside of the magnification display section of the control panel is dragged to set the magnification to 5000 (5 k) times. A focus knob [COARSE] on the operation panel is rotated to adjust the aperture alignment when the focus is adjusted to some extent. [Align] on the control panel is clicked to display an alignment dialog, and [Beam] is selected. STIGMA/ALIGNMENT knobs (X, Y) on the operation panel are rotated to move the displayed beam to the center of the concentric circles. Next, [Aperture] is selected and the STIGMA/ALIGNMENT knobs (X, Y) are rotated one by one to stop the movement of the image or adjust the movement to the minimum. The aperture dialog is closed and focusing is performed by autofocus. This operation is repeated twice to focus.

After that, the particle diameter of 300 toners is measured to obtain the number average particle diameter (D1). The particle diameter of each particle is the maximum diameter when the toner particle is observed.

(4) Focus Adjustment

For the particles with the number average particle diameter (D1) of ±0.1 μm obtained in (3), the inside of the magnification display section of the control panel is dragged to set the magnification to 10,000 (10 k) times.

The focus knob [COARSE] on the operation panel is rotated to adjust the aperture alignment when the focus is adjusted to some extent. [Align] on the control panel is clicked to display the alignment dialog, and [Beam] is selected. The STIGMA/ALIGNMENT knobs (X, Y) on the operation panel are rotated to move the displayed beam to the center of the concentric circles. Next, [Aperture] is selected and the STIGMA/ALIGNMENT knobs (X, Y) are rotated one by one to stop the movement of the image or adjust the movement to the minimum. The aperture dialog is closed and focusing is performed by autofocus.

After that, the magnification is set to 50,000 (50 k) times, the focus is adjusted using the focus knob and STIGMA/ALIGNMENT knobs in the same way as above, and refocusing is performed with autofocus. This operation is repeated again to focus. Here, where the inclination angle of the observation surface is large, the measurement accuracy of the coverage tends to be low, so a mode in which focusing is achieved on the entire observation surface at the same time is selected to perform analysis by selecting the configuration with the least inclination of the surface.

(5) Image Storage

The brightness is adjusted in an ABC mode, and an image is captured with a size of 640 pixels×480 pixels and saved.

The following analysis is performed using this image file. One image is captured for each toner particle to obtain images of 25 toner particles.

(6) Image Analysis

Using the following analysis software, the coverage is calculated by binarizing the images obtained by the above method. At this time, the screen is divided into 12 squares and each square is analyzed.

The analysis conditions for the image analysis software image-Pro Plus ver. 5.0 are as follows. However, where an organosilicon polymer having a particle diameter of less than 30 nm and more than 300 nm or an external additive such as silica fine particles having a particle diameter of less than 30 nm and more than 1200 nm are contained in the divided zone, the coverage is not calculated in that zone.

In the image analysis software Image-Pro Plus ver. 5.0,

"Count/Size" and "Options" are successively selected from "Measurement" on the toolbar and the binarization conditions are set. A total of 8 connections are selected in the object extraction options and the smoothing is set to 0. In addition, pre-sort, fill holes, and enveloping line are not selected, and "Exclude Borders" is set to "No". "Measurement Item" is selected from "Measurement" on the toolbar, and from 2 to $10^7$ is inputted in the area selection range.

The coverage is calculated by enclosing a square region. At this time, the area (C) of the region is set to from 24,000 to 26,000 pixels. Automatic binarization is performed by setting binarization in the "Treatment", and the total area (D) of the region without the organosilicon polymer is calculated.

From the area C of the square region and the total area D of the region without the organosilicon polymer, the coverage can be calculated by the following formula.

$$\text{Coverage (\%)}=100-(D/C*100).$$

The arithmetic mean value of all the obtained data is used as the coverage ratio.

Then, the coverage of each of the toner before washing with water and the toner after washing with water is calculated,

[Coverage of toner after washing with water]/[Coverage of toner before washing with water]×100 is defined as "an affixing ratio of the organosilicon polymer to a toner base particle".

Method for Measuring Toner Viscoelasticity G and G'

The viscoelasticity of the toner is measured using a rheometer ARES-G2 manufactured by TA Instruments.

Using a press machine NT-100H-V9 of NPa System Co., Ltd., a sample with a diameter of Φ8 mm and a thickness of about 2 mm is prepared.

In the examples of the first embodiment and the second embodiment, the temperature of the surface of the fixing film when the recording material was nipped and conveyed by the fixing nip portion was 150° C. Therefore, the temperature setting of the rheometer was 150° C.

The frequency setting of the rheometer was measured in a mode of measuring 20 points from 1 Hz to 100 Hz. In the examples of the first embodiment and the second embodiment, since the process speed was 130 mm/sec and the fixing nip width was 5 mm, the time when the paper and the toner thereon were pressed in the fixing nip portion Nf was about 0.04 sec. During this 0.04 sec, a slightly stronger stress is applied to the paper and the toner thereon twice, namely, when entering the fixing nip portion Nf and when coming out therefrom. Therefore, it was presumed that two waves of stress are applied during 0.04 sec and it was decided to refer to the value of the storage elastic modulus at a frequency of 50 Hz.

After confirming that the temperature of the rheometer chamber reached the set value of 150° C., the measurement was started 5 min after the sample was inserted.

Where the temperature of the surface of the fixing film when the recording material is nipped and conveyed by the fixing nip is a temperature other than 150° C., the temperature setting value of the rheometer chamber is also changed. For example, when the temperature of the surface of the fixing film when the recording material is nipped and conveyed by the fixing nip portion is 165° C., the set value of the temperature of the chamber of the rheometer is 165° C.

Examples of First Embodiment

A specific method for producing the toner used in this embodiment is described hereinbelow. However, the configuration according to the present disclosure is not limited to the configuration embodied in the examples. In addition, "parts" used in Examples and Comparative Examples are based on mass unless otherwise specified.

Production Example of Toner 6

Preparation Step of Aqueous Medium 1

A total of 14.0 parts of sodium phosphate (12-hydrate manufactured by Rasa Industries, Ltd.) was put into 650.0 parts of ion exchange water in a reaction vessel equipped with a stirrer, a thermometer, and a return pipe, and the temperature was kept at 65° C. for 1.0 h while purging with nitrogen.

A calcium chloride aqueous solution in which 9.2 parts of calcium chloride (dihydrate) was dissolved in 10.0 parts of ion exchange water was batch-loaded while stirring at 15,000 rpm by using T. K. Homomixer (manufactured by Tokushu Kagaku Kogyo Co., Ltd.) to prepare an aqueous medium containing a dispersion stabilizer. Further, 10% by mass of hydrochloric acid was added to the aqueous medium to adjust the pH to 5.0 and obtain an aqueous medium 1.

Preparation Step of Polymerizable Monomer Composition

Styrene 60.0 parts

Carbon black 6.5 parts

The above materials were put into an attritor (manufactured by Mitsui Miike Machinery Co., Ltd.) and further dispersed using zirconia particles having a diameter of 1.7 mm at 220 rpm for 5.0 h to prepare a pigment-dispersed solution. The following materials were added to the pigment-dispersed solution.

Styrene 20.0 parts n-Butyl acrylate 20.0 parts

Crosslinking agent (divinylbenzene) 0.90 parts

Saturated polyester resin 5.0 parts (Polycondensate of propylene oxide-modified bisphenol A (2 mole adduct) and terephthalic acid (molar ratio 10:12), glass transition temperature Tg=68° C., weight average molecular weight Mw=10,000, molecular weight distribution Mw/Mn=5.12)

Fisher-Tropsch wax (melting point 78° C.) 7.0 parts

The components were kept at 65° C. and uniformly dissolved and dispersed at 500 rpm by using T. K. Homomixer (manufactured by Tokushu Kagaku Kogyo Co., Ltd.) to prepare a polymerizable monomer composition.

Granulation Step

The polymerizable monomer composition was put into the aqueous medium 1 while keeping the temperature of the aqueous medium 1 at 70° C. and maintaining the rotation speed of the T. K. Homomixer at 15,000 rpm, and 10.0 parts of t-butylperoxypivalate was added as a polymerization initiator. Granulation was carried out for 10 min while maintaining 15,000 rpm of the stirring device as it was.

Polymerization—Distillation Step

After the granulation step, the stirrer was replaced with a propeller stirring blade, polymerization was carried out for 5.0 h while stirring at 150 rpm and keeping the temperature at 70° C., the temperature was raised to 85° C. and heating was performed for 2.0 h to carry out the polymerization reaction.

After that, the return pipe of the reaction vessel was replaced with a cooling pipe, and the slurry was heated to 100° C. to carry out distillation for 6 h to distill off the unreacted polymerizable monomer and obtain a toner base particle-dispersed solution.

Polymerization Step of Organosilicon Compound

A total of 60.0 parts of ion exchange water was weighed in a reaction vessel equipped with a stirrer and a thermometer, and the pH was adjusted to 4.0 with 10% by mass of hydrochloric acid. The system was heated under stirring to bring the temperature to 40° C. Then, 40.0 parts of methyltriethoxysilane, which is an organosilicon compound, was added and hydrolysis was performed for at least 2 h under stirring. The end point of the hydrolysis was visually confirmed by that the oil and water did not separate and became one layer, and the system was cooled to obtain a hydrolyzed liquid of an organosilicon compound.

After cooling the obtained toner base particle-dispersed solution to 55° C., 25.0 parts of the hydrolyzed liquid of the organosilicon compound was added to start the polymerization of the organosilicon compound. After holding for 15 min as it was, the pH was adjusted to 5.5 with a 3.0% aqueous solution of sodium hydrogen carbonate. After holding for 60 min while continuing stirring at 55° C., the pH was adjusted to 9.5 with a 3.0% aqueous solution of sodium hydrogen carbonate, and the mixture was further held for 240 min to obtain a toner particle-dispersed solution.

Washing and Drying Step

After the polymerization step was completed, the toner particle-dispersed solution was cooled, hydrochloric acid was added to the toner particle-dispersed solution to adjust the pH to 1.5 or less, and the solution was stirred for 1 h, allowed to stand, and then solid-liquid separated with a pressure filter to obtain a toner cake. The toner cake was reslurried with ion exchange water to form a dispersion liquid again, and then solid-liquid separated with the filter to obtain a toner cake.

The obtained toner cake was dried and classified in a constant temperature bath at 40° C. for 72 h to obtain toner particles 6. The toner particles 6 were used as they were as the toner 6.

Production Example of Toner 7

Preparation Step of Comparative Aqueous Medium 2

A total of 14.0 parts of sodium phosphate (12-hydrate manufactured by Rasa Industries, Ltd.) was put into 650.0 parts of ion exchange water in a reaction vessel equipped with a stirrer, a thermometer, and a return pipe, and the temperature was kept at 65° C. for 1.0 h while purging with nitrogen.

A calcium chloride aqueous solution in which 9.2 parts of calcium chloride (dihydrate) was dissolved in 10.0 parts of ion exchange water was batch-loaded while stirring at 15,000 rpm by using T. K. Homomixer (manufactured by Tokushu Kagaku Kogyo Co., Ltd.) to prepare an aqueous medium containing a dispersion stabilizer. Further, 10% by mass of hydrochloric acid was added to the aqueous medium to adjust the pH to 5.0 and obtain a comparative aqueous medium 2.

Preparation Step of Polymerizable Monomer Composition

Styrene 60.0 parts

Carbon black 6.5 parts

The above materials were put into an attritor (manufactured by Mitsui Miike Machinery Co., Ltd.) and further dispersed using zirconia particles having a diameter of 1.7 mm at 220 rpm for 5.0 h to prepare a pigment-dispersed solution. The following materials were added to the pigment-dispersed solution.

Styrene 20.0 parts n-Butyl acrylate 20.0 parts

Crosslinking agent (divinylbenzene) 0.90 parts

Methyltriethoxysilane 10.0 parts

Saturated polyester resin 5.0 parts (Polycondensate of propylene oxide-modified bisphenol A (2 mole adduct) and terephthalic acid (molar ratio 10:12), glass transition temperature Tg=68° C., weight average molecular weight Mw=10,000, molecular weight distribution Fisher-Tropsch wax (melting point 78° C.) 7.0 parts The components were kept at 65° C. and uniformly dissolved and dispersed at 500 rpm by using T. K. Homomixer (manufactured by Tokushu Kagaku Kogyo Co., Ltd.) to prepare a polymerizable monomer composition.

Granulation Step

The polymerizable monomer composition was put into the comparative aqueous medium 2 while keeping the temperature of the comparative aqueous medium 2 at 70° C. and maintaining the rotation speed of T. K. Homomixer at 15,000 rpm, and 10.0 parts of t-butylperoxypivalate was added as a polymerization initiator. Granulation was carried out for 10 min while maintaining 15,000 rpm of the stirring device as it was.

Polymerization—Distillation Step

After the granulation step, the stirrer was replaced with a propeller stirring blade, and polymerization was carried out for 5.0 h while stirring at 150 rpm and keeping the temperature at 70° C. At this time, the pH of the aqueous medium was 5.1. Next, 10.0 parts of a 1.0 mol/L-NaOH aqueous solution was added to bring the pH to 8.0, the temperature was raised to 85° C., and heating was performed for 2.0 h to carry out the polymerization reaction. Then, an aqueous solution prepared by dissolving 4.0 parts of 10% hydrochloric acid in 50 parts of ion exchange water was added to adjust the pH to 5.1.

After that, the return pipe of the reaction vessel was replaced with a cooling pipe, and the slurry was heated to 100° C. to carry out distillation for 6 h to distill off the unreacted polymerizable monomer and obtain a toner base particle-dispersed solution.

Washing and Drying Step

After the polymerization step is completed, the toner particle-dispersed solution was cooled, hydrochloric acid was added to the toner particle-dispersed solution to adjust the pH to not more than 1.5, and the solution was stirred for 1 h, allowed to stand, and then solid-liquid separated with a pressure filter to obtain a toner cake. The toner cake was reslurried with ion exchange water to form a dispersion liquid again, and then solid-liquid separated with the filter to obtain a toner cake.

The obtained toner cake was dried and classified in a thermostat at 40° C. for 72 h to obtain comparative toner particles 7. The comparative toner particles 7 were used as they were as a toner 7. Table 1 shows the production conditions of comparative toner particles 7.

Production Method of Comparative Toner Particles 8 and Toner Particles 9

Comparative toner particles 8 and toner particles 9 were obtained in the same manner as the toner particles 1 except that the conditions were changed as shown in Table 1. The comparative toner particles 8 and the toner particles 9 were used as they were as toners 8 and 9, respectively. The production conditions of the comparative toner particles 8 and the toner particles 9 are shown in the table hereinbelow.

Production Method of Comparative Toner 10

In the production method of the toner particles 6, the step of polymerizing the organosilicon compound was omitted, and an external additive was added to the produced toner base particles under the following conditions to prepare comparative toner 10.

A total of 3.0 parts of hydrophobic sol-gel silica (manufactured by Nippon Aerosil Co., Ltd.: number average diameter 80 nm) was added to 100 parts of the comparative toner particles 10, and mixed with a Henschel mixer at a peripheral speed of the stirring blade of 20 m/s to produce a comparative toner 10.

TABLE 1

| | Amount of crosslinking agent (parts) | Type of organosilicon compound | Addition amount (parts) | Condensation reaction 1 pH | Condensation reaction 1 hours | Condensation reaction 2 pH | Condensation reaction 2 hours | Temperature (° C.) |
|---|---|---|---|---|---|---|---|---|
| Toner particle 6 | 0.90 | Methyltriethoxysilane | 10.0 | 5.5 | 1 | 9.5 | 4 | 55 |
| Comparative toner particle 7 | 0.90 | Methylthethoxysilane | 10.0 | — | — | — | — | 55 |
| Comparative toner particle 6 | 0.50 | Methyltriethoxysilane | 10.0 | 5.5 | 1 | 9.5 | 4 | 55 |
| Toner particle 9 | 0.75 | Methylmethoxysilane | 10.0 | 5.5 | 1 | 9.5 | 4 | 55 |
| Comparathe toner particle 10 | 0.90 | — | 3 parts of external additive | — | — | — | — | 55 |

Production Example of Toners 1 to 5

Toner particles 1 to 5 were obtained in the same manner as in the production example of toner 6 except that the amount of the crosslinking agent (divinylbenzene) used was changed as shown in Table 2. The toner particles 1 to 5 were used as they were as toners 1 to 5.

TABLE 2

| Fixing nip pressure σ = 0.12 Mpa | | | | | Convex portion | Affixing | | Shape retension | | Readability |
|---|---|---|---|---|---|---|---|---|---|---|
| Toner No. | Crosslinking agent (parts) | P (D/W) | ΣW/L | H80 (nm) | diameter R (nm) | ratio (%) | Viscoelasticity Gof toner | ratio of toner | Gloss | of characters |
| 3 | 0.30 | 90 | 0.61 | 90 | 45 | 95 | 0.030 MPa | 10% | 30 | NG |
| 4 | 0.50 | 90 | 0.61 | 90 | 45 | 95 | 0.050 MPa | 30% | 25 | NG |
| 5 | 0.70 | 90 | 0.61 | 90 | 45 | 95 | 0.065 MPa | 45% | 10 | NG |
| 1 | 0.80 | 90 | 0.61 | 90 | 45 | 95 | 0.072 MPa | 60% | 5.0 | GOOD |
| 2 | 1.10 | 90 | 0.61 | 90 | 45 | 95 | 0.090 MPa | 80% | 4.5 | GOOD |

Relationship Between Gloss of Output Image Sample and Readability of Characters

The gloss was obtained by measuring, with a gloss meter PG-II (75) manufactured by Nippon Denshoku Industries Co., Ltd., an image similar to the solid black image for which the shape retention ratio of the toner was measured. In addition, a character image was also output under the same conditions, and the readability of the characters was confirmed. As described above, in an image having a high gloss, the reflected light of the light that falls on the image has a strong specular reflection component. Therefore, the image looks partially white, which makes the document difficult to read.

Table 2 shows the results of an experiment conducted to investigate the relationship between the gloss of the output image measured as described above and the readability of characters. The shape retention ratio of the toner, the gloss at the time of solid black image output and the readability of the characters at the time of character image output were evaluated when the relationship between the viscoelasticity G of the toner and the fixing nip pressure σ×0.6 was changed by changing the viscoelasticity G of the toner using the image forming apparatus of the present embodiment. Since the temperature of the fixing film surface was set to 150° C., the viscoelasticity of the toners 1 to 5 in Table 2 is G=G'.

The viscoelasticity G (G') of the toner increases as the molecular weight of the binder resin constituting the toner particle increases, and the molecular weight of the binder resin can be adjusted by increasing or decreasing the amount of the crosslinking agent added when the polymerizable monomer is polymerized. The detailed method for producing the toner is as described above. In the toners 1 to 5, divinylbenzene was used as the crosslinking agent, and the viscoelasticity G (G') could be increased as the amount of the crosslinking agent was increased in the range of from 0.30 to 1.10 parts.

As the toner viscoelasticity G (G') increases, the shape retention ratio of the toner on the outputted image increases, and the gloss decreases. Under the condition that the fixing nip pressure σ was 0.12 MPa, when the toner viscoelasticity G (G') was at least 0.072 MPa, the toner shape retention ratio was at least 60%, and the gloss of the image could reach the target of not more than 5.0.

It was confirmed that the lower the gloss, the better the readability of the characters, and when the gloss was not more than 5.0, a document with sufficient readability could be obtained. The target value of gloss in the present embodiment was not more than 5.0, the readability of characters when the gloss was not more than 5.0 was considered to be good (GOOD), and the readability of characters when the gloss exceeded 5.0 was NG. It was found that when the toner viscoelasticity G (G') was the fixing nip at least σ×0.6, the shape retention ratio of the toner was at least 60%, the gloss of the image was sufficiently low, and a document with good readability could be obtained.

It is presumed that the reason why the gloss is lowered by setting the relationship between the toner viscoelasticity G (G') and the fixing nip σ×0.6 within a specific range is due to the unevenness of paper.

Paper generally used in office environments has irregularities larger than the toner diameter. The fixing film that comes into direct contact with the paper and the toner on the paper is generally a resin film, and the surface of the fixing film is often not soft enough to completely imitate the unevenness of the paper. In that case, the fixing nip pressure σ acts largely on the projections on the paper and decreases on the recesses.

Figure 7A:
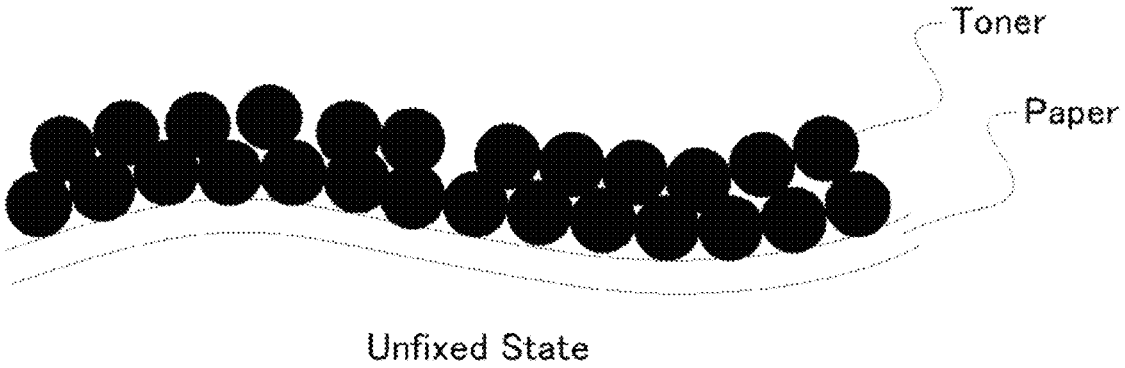
FIG. 7A is a schematic cross-sectional view of toner outputted on paper.

FIGS. 7A to 7D are schematic cross-sectional views of the toner outputted on paper having irregularities. FIG. 7A shows the toner in an unfixed state before passing through the fixing device 6, and shows how about from 2 to 3 toner layers are formed on paper having irregularities by the above-described image formation step.

Figure 7B:
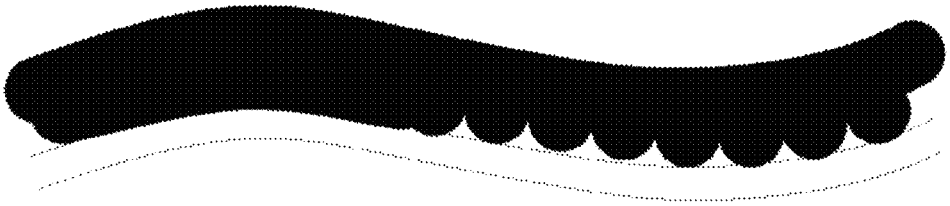
FIG. 7B is a schematic cross-sectional view of toner outputted on paper.
Figure 7C:
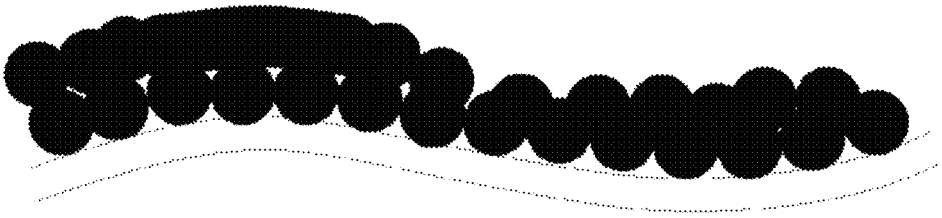
FIG. 7C is a schematic cross-sectional view of toner outputted on paper.
Figure 7D:
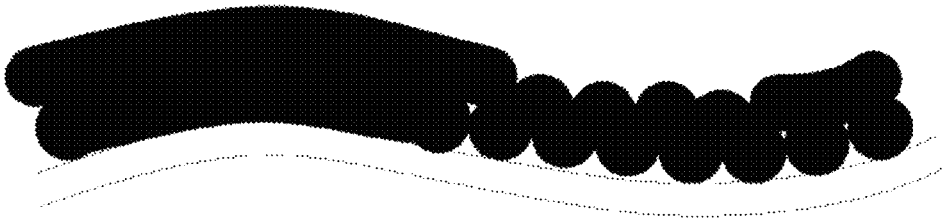
FIG. 7D is a schematic cross-sectional view of toner outputted on paper.

FIGS. 7B to 7D show the paper and the toner on the paper, which are shown in FIG. 7A, in a state after passing through the fixing device 6. In FIG. 7B, since the toner has a low viscoelasticity G (G') and is soft, or the fixing nip pressure σ is high, the viscoelasticity G (G') and the fixing nip pressure σ do not satisfy the predetermined relationship, and the toner present in the uppermost layer melts and spreads to form a smooth film. When there are many regions where the toner is crushed and smoothed in this way, the reflected light of the light incident on the paper surface has a large specular reflection component. Therefore, the gloss of the output image becomes high.

In FIG. 7C, the viscoelasticity G (G') of the toner is higher than that in FIG. 7B, or the fixing nip pressure σ is lower than that in FIG. 7B, so that the viscoelasticity G (G') and the fixing nip pressure σ satisfy the predetermined relationship, and the shape of the toner is partially retained in the region of a recess on the paper where the fixing nip pressure σ is unlikely to act. FIG. 7D shows a case where the viscoelasticity G (G') of the toner is even higher or the fixing nip pressure σ is even lower, and the region where the toner shape is retained in the recess on the paper is further increased as compared with FIG. 7C.

Comparing FIGS. 7B to 7D in this way, since the fixing nip pressure σ acts strongly on the projections of the paper, a smooth film is likely to be formed. Meanwhile, it can be seen that the sim of the region where the shape of the toner is retained changes in the recess of the paper. When there are many regions where the shape of the toner is retained, the reflected light of the light incident on the paper surface has a large specular reflection component. Therefore, the gloss is low.

As shown above, it is considered that the gloss of the output image depends on how much the shape of the toner present in the recesses on the paper in the entire paper is retained even after passing through the fixing device 6.

Meanwhile, the applied pressure that is received by the toner present in the recesses on the paper was estimated by modeling the paper, the fixing film surface and the toner on the basis of the results obtained by measuring the unevenness of the paper with a laser microscope VK-X250 manufactured by KEYENCE Corp, and it was found that only about 60% of the fixing nip pressure σ was acting in the recesses.

From the above, by setting the toner viscoelasticity G (G') and the fixing nip pressure σ so that the toner viscoelasticity G (G') is at least 0.6 times the fixing nip pressure σ, the toner present in the recesses on the paper can be prevented from being crushed and smoothed, a state can be created in which a large amount of toner retaining the shape is present in the recesses on the paper, as shown in FIGS. 7C and 7D, and a low-gloss output image can be obtained.

Effect of Suppressing Toner Contamination of Fixing Film by Organosilicon Polymer Meanwhile, by using the toner in which the organosilicon polymer forms convex portions on the outer surface of the toner particle as described above, toner contamination of the fixing film is suppressed. The effect will be described with reference to FIGS. 8A to 8C.

Figure 8A:
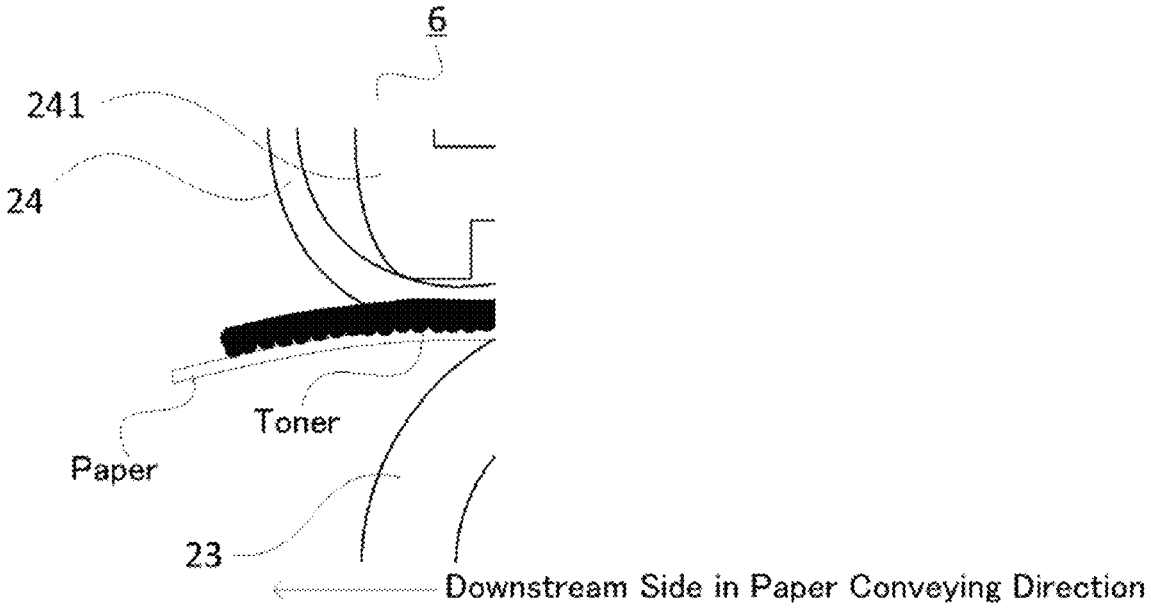
FIG. 8A is a schematic cross-sectional view of the fixing device on the downstream side in the paper conveying direction.
Figure 8B:
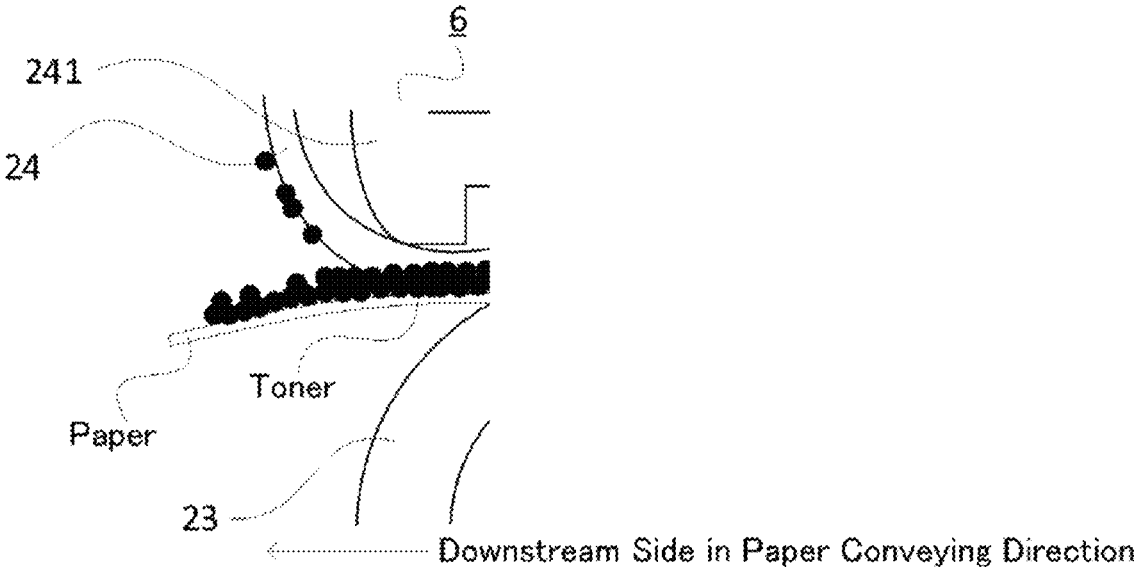
FIG. 8B is a schematic cross-sectional view of the fixing device on the downstream side in the paper conveying direction.
Figure 8C:
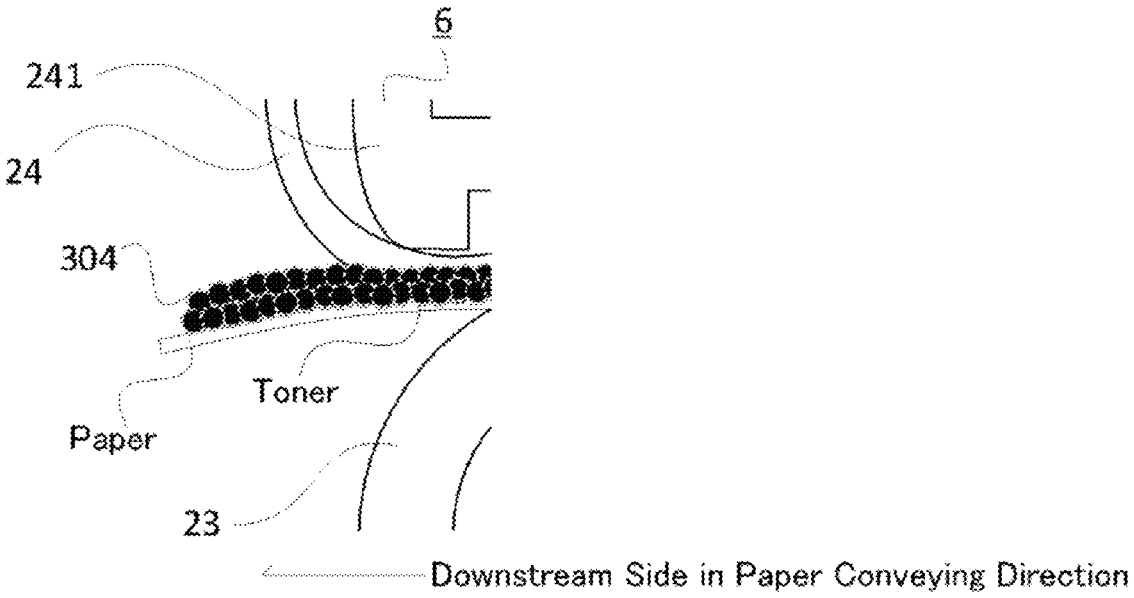
FIG. 8C is a schematic cross-sectional view of the fixing device on the downstream side in the paper conveying direction.

FIGS. 8A to 8C are schematic cross-sectional views on the downstream of the fixing device 6 side in the paper conveying direction at the time of conveying the paper on which the toner image has been formed in the fixing device 6. Toner contamination of the fixing film is likely to occur because the toner is not crushed to be smooth even after passing through the fixing device 6, or because the convex portions of the toner surface after passing through the fixing device 6 are moved, detached or embedded.

FIG. 8A shows a state in which the viscoelasticity G (G') and the fixing nip pressure σ do not satisfy a predetermined relationship because the toner viscoelasticity G (G') is small or the fixing nip pressure σ is high, and the toner is mostly in the crushed state after passing through the fixing device 6. In such a case, the toner on the paper melts and spreads to form a smooth film between adjacent toner particles, and the toner particles are strongly bonded to each other. Therefore, toner contamination of the fixing film is unlikely to occur.

FIG. 8B shows a state in which the toner viscoelasticity G (G') is increased or the fixing nip pressure σ is decreased, for example, in order to reduce the gloss of the output image, and the toner retains the particulate shape without being crushed. In such a case, the bonding between adjacent toner particles is very weak and such toner tends to offset to the fixing film.

Further, as another example illustrated by FIG. 8B, a case can be considered in which the viscoelasticity G (G') of the toner may be too low even though the convex portions 304 of the organosilicon polymer have been formed on the outer surface of the toner particle. When the viscoelasticity G (G') of the toner is low and the toner is soft, the convex portions 304 of the organosilicon polymer formed on the outer surface of the toner particle are moved, detached or embedded during the electrophotographic processes of development and transfer, the convex portions 304 disappear from the toner surface after passing through the fixing device 6, and the below-described effect of suppressing toner contamination of the fixing film by the convex portions cannot be obtained.

Conventionally, in order to suppress toner contamination of the fixing film, the fixing temperature was raised or the fixing nip pressure was raised to crush the toner and make it difficult for the toner to offset. That is, the toner was crushed to the state shown in FIG. 8A. As a result, there were cases where the performance of reducing the gloss of the toner as described above could not be fully exhibited.

FIG. 8C shows the state of the present example, in which the convex portions 304 formed on the outer surface of the toner remained on the paper even after the paper has passed through the fixing device 6. Where the convex portions 304 are present on the outer surface of the toner particle, the contact area with the fixing film is reduced, so that the toner is unlikely to transfer to the fixing film even if the adhesion between adjacent toner particles is weak. Therefore, contamination of the fixing film by the toner can be suppressed.

As shown above, by increasing the toner viscoelasticity G (G'), specifically to at least 0.060 MPa, and setting the fixing nip pressure σ to be smaller than the toner viscoelasticity G, specifically so as to satisfy $G \geq \sigma \times 0.6$ or $G' \geq \sigma \times 0.6$, G while suppressing the movement, detachment, and embedment of the convex portions, it is possible to suppress the contamination of the fixing film and also to reduce the gloss (a state where there is little crushed toner) of the output image.

Features of Examples of Present Embodiment

Features of the examples of the present embodiment will be summarized and described hereinbelow.

The toner of the present examples comprises a toner particle having a toner base particle and an organosilicon polymer on the surface of the toner base particle, the organosilicon polymer has a structure represented by the formula (1) and the organosilicon polymer forms convex portions on the outer surface of the toner particle.

Where a contour line of the toner base particle in a cross-sectional image of the toner particle obtained by STEM is straightened to a straight line to obtain a straightened image of the cross-sectional image, assuming that in the straightened image, the length of the straight line is taken as L, the length of a line segment of a portion constituting a boundary of the convex portion and the toner base particle in the straight line is taken as a convex portion width W, the maximum length of the convex portion in the normal direction of the convex portion width W is taken as a convex portion diameter D, and the length from an apex of the convex portion in the line segment forming the convex portion diameter D is taken as a convex portion height H, the condition of the convex portion diameter D=the convex portion height H is satisfied.

With such a configuration, it is possible to prevent the convex portions from moving and detaching due to stress applied to the toner during the image forming process, and to ensure the number of convex portions remaining after fixing, so the effect of suppressing the contamination of the fixing film is exerted.

Further, the toner viscoelasticity G (G') is at least 0.060 MPa. In the examples of Table 3, the toner 6 having a viscoelasticity G (G') of 0.080 MPa and the toner 9 having a viscoelasticity G (G') of 0.070 MPa were used. The higher the toner viscoelasticity G (G') is, that is, the harder the toner particles are, the less likely it is that the convex portions will be embedded even after the electrophotographic processes of development, transfer, and fixing, and a state in which the convex portions remained on the outer surface of the toner particle on the fixed image can be maintained. Therefore, the effect of suppressing the contamination of the fixing film can be exhibited.

Using such toner, in the fixing device of the examples shown in Table 3, the fixing nip pressure was set to 0.12 MPa in Example 1-1 and to 0.08 MPa in Example 1-2 so that the fixing nip pressure σ satisfy the relationship of $G \geq \sigma \times 0.6$ with the viscoelasticity G of the toner, and that the fixing nip pressure σ satisfy the relationship of $G' \geq \sigma \times 0.6$ with the viscoelasticity G' of the toner. As described above, when the viscoelasticity G (G') of the toner was at least 0.072 MPa under the condition that the fixing nip pressure σ was 0.12 MPa, and when the viscoelasticity G (G') of the toner was 0 at least 0.048 MPa under the condition that the fixing nip pressure σ was 0.08 MPa, the toner shape retention ratio was at least 60%, and the gloss of the image could reach the target of not more than 5.0. The lower the gloss, the better the readability of characters, and when the gloss is not more than 5.0, a sufficiently readable document is obtained.

TABLE 3

| | Toner | | | | Viscoelasticity | Fixing nip | | |
|---|---|---|---|---|---|---|---|---|
| | No | Organosilicon polymer | * | Viscoelasticity G of toner | G' of toner (Mpa) | pressure σ | 0.6 × σ (Mpa) | P(D/W) |
| Example 1-1 | Toner 6 | Present | D = H | 0.080 MPa | 0.080 | 0.12 MPa | 0.072 | 90 |
| Conventional Example | Toner 7 | Present | No convex | 0.080 MPa | 0.080 | 0.12 MPa | 0.072 | — |
| Comparative Example 1 | Toner 7 | Present | No convex | 0.080 MPa | 0.080 | 0.14 MPa | 0.084 | — |

TABLE 3-continued

| | | | | | | | | |
|---|---|---|---|---|---|---|---|---|
| Comparative Example 2 | Toner 7 | Present | No convex | 0.050 MPa | 0.080 | 0.12 MPa | 0.072 | — |
| Comparative Example 3 | Toner 8 | Present | D = H | 0.050 MPa | 0.050 | 0.08 MPa | 0.048 | 90 |
| Example 1-2 | Toner 9 | Present | D = H | 0.070 MPa | 0.070 | 0.08 MPa | 0.048 | 90 |
| Comparative Example 4 | Toner 10 | Present | D > H | 0.070 MPa | 0.070 | 0.08 MPa | 0.048 | 0 |

| | ΣW/L | H80 (nm) | Convex portion diameter R (nm) | Affixing ratio (%) | Shape retention ratio of toner | Gloss | Fixing film contamination |
|---|---|---|---|---|---|---|---|
| Example 1-1 | 0.61 | 90 | 45 | 95 | 70% | 4.8 | GOOD |
| Conventional Example | — | — | — | — | 70% | 4.8 | NG |
| Comparative Example 1 | — | — | — | — | 45% | 10 | GOOD |
| Comparative Example 2 | — | — | — | — | 30% | 25 | GOOD |
| Comparative Example 3 | 0.61 | 90 | 45 | 95 | 75% | 4.5 | NG |
| Example 1-2 | 0.61 | 90 | 45 | 95 | 80% | 4.5 | GOOD |
| Comparative Example 4 | 0.40 | 60 | 80 | 75 | 80% | 4.5 | NG |

In Table 3, * denotes relationship between convex portion diameter D and convex portion height H.

Verification Text Results

Figure 9:
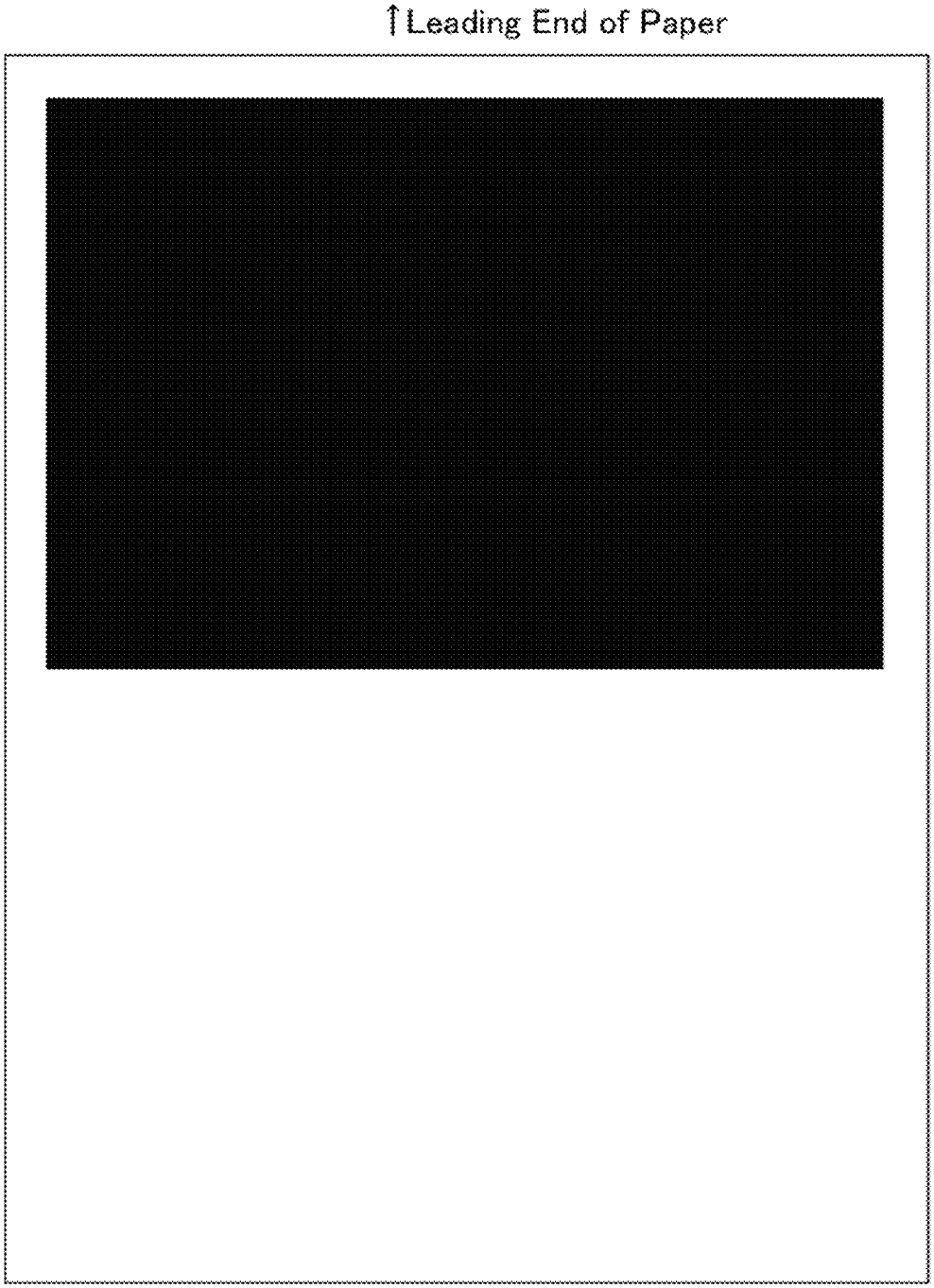
FIG. 9 is an image used in the example.

In order to confirm the effect of the above-described example, a solid black image was outputted from the leading end of the paper to the center of the paper shown in FIG. 9 with the image forming apparatus of the present example, and the shape retention ratio and gloss of the toner and the fixing film contamination were evaluated. The results will be described with reference to Table 3.

The evaluation of the shape retention ratio and gloss of the toner is the same as the method described above, so the explanation thereof is herein omitted. As described above, the target value of the gloss of the solid black image is not more than 5.0 from the viewpoint of the readability of characters.

In the evaluation of the fixing film contamination, the image stain (offset) generated in the white part at the rear end of the paper was evaluated using the same image in FIG. 9 as the output image in which the shape retention ratio and gloss of the toner after passing through the fixing device were evaluated. Where toner contamination of the fixing film occurs in the black part at the leading end of the paper, the toner adheres to the paper after one round of the fixing film from the portion where the toner has adhered, resulting in an image stain. Where an image stain in which the toner adheres to the white portion at the rear end of the paper has occurred, the result was regarded as NG, and where no image stain has occurred, the result was regarded as GOOD.

In the image forming apparatus of Examples 1-1 and 1-2 and Comparative Examples 1 to 4 shown in Table 3, the temperature control temperature of the heater 242 was set to 180° C., except for Comparative Example 2, and the temperature of the fixing film surface when the recording material was nipped and conveyed by the fixing nip portion at this time was 150° C. Accordingly, in Examples 1 and 2 and Comparative Examples 1, 3, and 4, the storage elastic modulus measured at 150° C. and 50 Hz was taken as viscoelasticity G. The fixing nip pressure σ was set as shown in Table 3.

In Example 1-1, the toner 6 in which the convex portions of the organosilicon polymer were formed on the outer surface of the toner particle was used.

The viscoelasticity G of the toner 6 was 0.080 MPa. and the viscoelasticity G' was also 0.080 MPa. Further, the image forming apparatus was adjusted so that the fixing nip pressure σ was 0.12 MPa.

In Example 1-1, the shape retention ratio of the toner on the output image was 70%, and the gloss was 4.8, which was not more than the target value of 5.0. In addition, the above-mentioned image stains were not observed.

In the conventional example, the toner 7 was used in which the viscoelasticity G of the toner and the fixing nip pressure σ were designed to satisfy a predetermined relationship by adjusting the amount of the crosslinking agent used, but the convex portions of the organosilicon polymer were not formed on the outer surface of the toner particle.

The viscoelasticity G of the toner 7 was 0.080 MPa, and the viscoelasticity G' was also 0.080 MPa. Further, the image forming apparatus was adjusted so that the fixing nip pressure σ was 0.12 MPa.

In the conventional example, the shape retention ratio of the toner on the output image was 70%, and the gloss was 4.8, which was not more than the target value of 5.0. However, at the temperature of the fixing film surface when the recording material was nipped and conveyed by the fixing nip portion, the releasability of the toner could not be sufficiently exhibited, and the fixing film was contaminated with the toner.

In Comparative Example 1, the toner 7 was used and the fixing nip pressure σ was set to 0.14 MPa, which is 0.02 MPa higher than that of the conventional example, in order to strongly bond the adjacent toner particles on the paper to suppress toner contamination on the fixing film.

The value obtained by multiplying the fixing nip pressure σ by 0.6 is 0.084 MPa, which is larger than the viscoelasticity G of the toner. Therefore, the region where the toner formed a smooth film on the output image after passing through the fixing device 6 increased, and the shape retention ratio of the toner decreased to 45%. In addition, the gloss showed 10 exceeding the target value of 5.0. Toner contamination of the fixing film could be prevented, but the image was not in a state with a sufficiently low gloss.

In Comparative Example 2, the toner 7 was used and the temperature control temperature of the heater 242 in the fixing device 6 was set 20° C. higher in order to suppress toner contamination on the fixing film.

Since it could be confirmed that when the temperature control temperature was set 20° C. higher, the temperature of the fixing film surface also increased by 15° C., the toner 7 was the same as the toner shown in the conventional example and Comparative Example 1, but the storage elastic modulus at 165° C. was used as the viscoelasticity G of the toner.

The storage elastic modulus of the toner (toner 7) of Comparative Example 2 at 165° C. and 50 Hz was 0.050 MPa. Thus, it is necessary to change, as appropriate, the method for measuring the toner viscoelasticity G according to the surface temperature of the fixing film. Since the viscoelasticity G of the toner is 0.050 MPa and the fixing nip pressure σ is 0.12 MPa, the relationship of $G \geq \sigma \times 0.6$ is not satisfied. Therefore, similarly to Comparative Example 1, the region where the toner formed a smooth film on the output image after passing through the fixing device 6 increased, and the shape retention ratio of the toner decreased to 30%. Moreover, the gloss showed 25 which exceeded the target value of 5.0. Toner contamination of the fixing film could be prevented, but the image was not in a state with a sufficiently low gloss.

In Comparative Example 3, the toner 8 was used in which the organosilicon polymer formed convex portions satisfying the convex portion diameter D=the convex portion height H on the outer surface of the toner particle, in the same manner as in the toner 6, for the purpose of suppressing toner contamination on the fixing film. However, in this example, the amount of the crosslinking agent was adjusted, and a toner having a storage elastic modulus (viscoelasticity G of the toner) of 0.050 MPa at 150° C. and 50 Hz was used. The viscoelasticity G' of the toner 8 was also 0.050 MPa.

Further, in Comparative Example 3, the fixing nip pressure σ was set to 0.08 MPa.

The shape retention ratio of the toner was 75%, and the gloss was 4.5, which was not more than the target value of 5.0, and low gloss was achieved. However, toner contamination of the fixing film occurred. This is apparently because even if the convex portions of the organosilicon polymer are formed on the outer surface of the toner particle, where the viscoelasticity G (G') of the toner particle is low and the particle is soft, the convex portions are embedded in the electrophotographic processes of development and transfer, the convex portions disappear from the outer surface of the toner particle after passing through the fixing device 6, and the effect of the convex portions cannot be obtained.

In Example 1-2, a toner 9 was used in which the amount of the crosslinking agent at the time of toner production was adjusted with respect to that of Comparative Example 3 and the viscoelasticity G was increased to 0.070 MPa. The viscoelasticity G' of the toner 9 was also 0.070 MPa.

It was confirmed that by setting the viscoelasticity G (G') to at least 0.060 MPa and at least 0.6 times the fixing nip pressure σ, it is possible to suppress the embedment of the convex portions during the electrophotographic process, and the effect of suppressing toner contamination of the fixing film can be obtained. This example satisfied the conditions of the present disclosure, and both low gloss and suppression of toner contamination of the fixing film could be achieved.

In Comparative Example 4, the toner production method was changed from that of Comparative Example 3 and Example 1-2, and the toner 10 was used in which a spherical organosilicon polymer was externally attached to the outer surface of the toner particle, that is, the convex portion diameter D was larger than the convex portion height H.

In this case, even though the convex portions of the organosilicon polymer had been formed on the outer surface of the toner particle, since the organosilicon polymer, which was an external additive, moved, detached and embedded during the electrophotographic processes of development, transfer, and fixing, the spherical organosilicon polymer 305 did not remain on the toner surface on the image after fixing, so that the fixing film contamination could not be suppressed.

As described above, where a toner is used which comprises a toner particle having a toner base particle and an organosilicon polymer on the toner base particle surface and in which the organosilicon polymer has a structure represented by the formula (1), the organosilicon polymer forms convex portions on the outer surface of the toner particle, and the convex portion diameter D=the convex portion height, and also the viscoelasticity G of the toner is at least 0.060 MPa, and the relationship of the fixing nip pressure σ satisfies $G \geq \sigma \times 0.6$, it is possible to achieve both low gloss of the output image and suppression of toner contamination on the fixing film.

Further, where a toner is used which comprises a toner particle having a toner base particle and an organosilicon polymer on the toner base particle surface and in which the organosilicon polymer has a structure represented by the formula (1), the organosilicon polymer forms convex portions on the outer surface of the toner particle, and the convex portion diameter D=the convex portion height, and also the viscoelasticity G' of the toner is at least 0.060 MPa, and the relationship of the fixing nip pressure σ satisfies $G' \geq \sigma \times 0.6$, it is possible to achieve both low gloss of the output image and suppression of toner contamination on the fixing film.

Second Embodiment

The second embodiment will be described hereinbelow.

In the preferred configuration shown in the second embodiment, the movement, detachment, and embedment of the convex portions of the organosilicon polymer formed on the outer surface of the toner particle can be suppressed while the toner is repeatedly stirred in the toner container even after durability, and the occurrence of toner contamination on the fixing film can be suppressed.

In the present embodiment, the holding member of the fixing device has a surface of the same height as the surface (surface for forming the fixing nip portion) of the heating member that contacts the inner surface of the fixing film, and a step is provided by a protruding portion projecting from the surface in the pressure member direction (pressure roller 23) on the downstream side of the heating member (fixing nip portion) in the recording material conveying direction. With such a configuration, it is possible to suppress toner contamination on the fixing film while maintaining low gloss of the output image even ater durability.

Since the toner used in Examples 2-1 to 2-3 is the same toner 6 as in Example 1-1, the description thereof will be omitted.

Since the image forming apparatus used in Examples 2-1 to 2-3 is the same as that of the first embodiment except for the configuration of the fixing device 6, the description thereof will be omitted. Further, each member of the fixing device 6, except for the heater holder, is the same as in the examples of the first embodiment, and the description thereof will be omitted.

Suppression of Fixing Film Contamination by Step A of Heater Holder

Figure 10A:
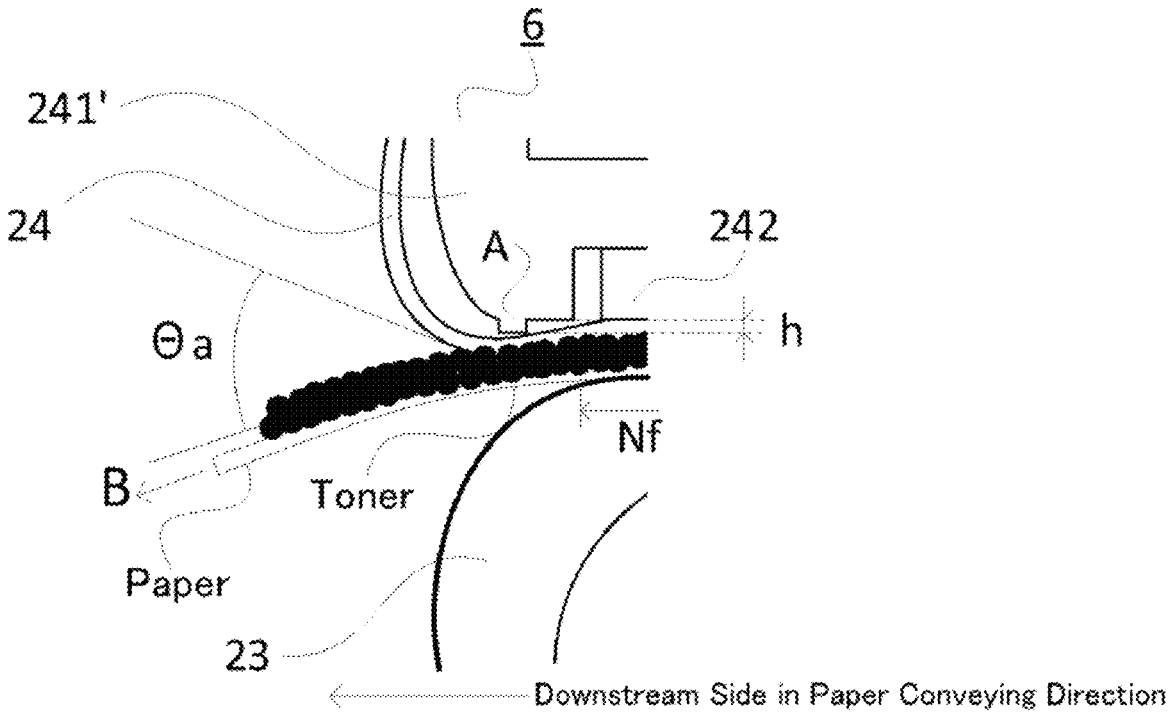
FIG. 10A is a schematic cross-sectional view of the fixing device on the downstream side in the paper conveying direction in the second embodiment.
Figure 10B:
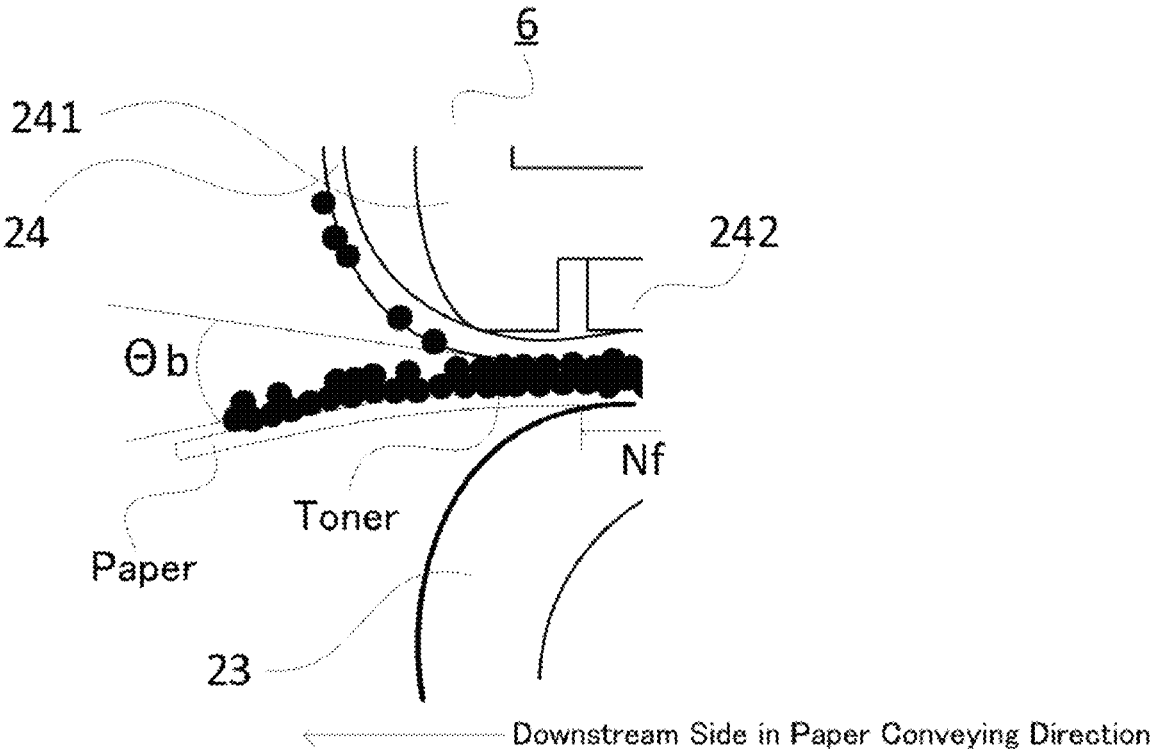
FIG. 10B is a schematic cross-sectional view of the fixing device on the downstream side in the paper conveying direction in the second embodiment.

A heater holder 241' of the present embodiment will be described with reference to the schematic cross-sectional view of the fixing device 6 of FIGS. 10A and 10B. FIG. 10A shows the fixing device 6 of the present embodiment, and the heater holder 241', which is a holding member for holding the heating member, is provided with a step A on the downstream side in the paper conveying direction with respect to the holding portion of the heater 242. The step A has a shape that projects by a height h in the direction of the pressure roller 23 with respect to the surface of the heater 242. That is, the heater holder 241' has, on the downstream of the heater 242 (fixing nip portion Nf) in the paper conveying direction, a surface of the same height as the surface (surface for forming the fixing nip portion Nf) of the heater 242 that contacts the inner surface of the fixing film 24. The step A is provided by a protruding portion projecting from the aforementioned surface toward the pressure member side (pressure roller 23 side) on the downstream side in the paper conveying direction further than the aforementioned surface. The tip (tip surface) of the protruding portion forming the step A guides the inner surface of the fixing film 24 so that a portion of the fixing film 24 that has passed through the fixing nip portion Nf is partially pressed within a predetermined range from the rear end of the fixing nip portion Nf against a portion of the paper that has passed through the fixing nip portion Nf. That is, the outer surface of the fixing film 24 and the image forming surface of the paper are maintained in contact with each other due to the action of the step A even after passing through the fixing nip portion Nf. In the present embodiment, the step A is formed by a protruding portion projecting from the abovementioned surface of the heater holder 241' in the direction perpendicular to the surface of the heater 242 contacting the inner surface of the fixing film 24, and the height h of the step A is measured in that direction. FIG. 10B is a comparative example and shows a fixing device 6 in which the heater holder 241 does not have such a step.

Since the heater holder 241 is provided with the step A, the trajectory of the fixing film 24 and the trajectory of the paper change. In the configuration provided with the step A as in the present embodiment, the portion of the fixing film 24 that has passed through the fixing nip portion Nf is in a direction of approaching the pressure roller 23 as compared with the configuration in which the step A is not provided. That is, the portion of the fixing film 24 that has passed through the fixing nip portion Nf is guided so as to be separated from the peripheral surface of the pressure roller 23 as the distance from the fixing nip portion Nf increases, but where the step A is provided, the degree of separation from the peripheral surface of the pressure roller 23 becomes smaller than in the case where the step A is not provided. The paper is discharged from the fixing nip portion Nf while curling along the peripheral surface of the pressure roller 23, but the degree of change in the guide trajectory of the fixing film 24 due to the step A is larger than the degree of curling of the paper, and the fixing film 24 is guided so as to push the paper toward the pressure roller 2 within a predetermined range even after passing through the fixing nip portion Nf. That is, by contrast with the case where the step A is not provided, the portion of the paper discharged from the fixing nip portion Nf is guided to be pushed down toward the pressure roller 23 by the pressure applied to the fixing film 24 by the step A even after separation from the peripheral surface of the pressure roller 23. The portion of the fixing film 24 that has passed through the step A portion faces in the direction of separation from the pressure roller 23, but the degree of conversion in the direction of the trajectory is larger than that in the case where the step A is not provided. Meanwhile, after passing through the fixing nip Nf, the paper is directed to approach the pressure roller 3 (as compared to the case where the step A is not provided) by the step A as in the case of the fixing film 24, and the paper proceeds, as it is, in the direction of the inward arrow B. Therefore, the paper and the fixing film 24 are separated from each other at the separation angle θa after the paper has passed through the fixing nip Nf. As a result of providing the step A, the separation angle θa is larger than the separation angle θb when the step is not provided, and the separability of the fixing film 24 and the paper and the toner on the paper is higher in the configuration shown in FIG. 10A than in the configuration shown in FIG. 10B.

The configuration for forming the above-described desired guide trajectory of the fixing film 24 and the paper is not limited to the above-described configuration using the step A. For example, not only a single protruding portion but also a plurality of protruding portions may be configured, and in that case, a plurality of protruding portions may be arranged side by side in the paper conveying direction or in a direction orthogonal to the paper conveying direction. Further, it is possible to form the protruding portion separately and attach it to the heater holder 241', rather than form the protruding portion integrally with the heater holder 241'. Further, the shape of the protruding portion is not limited to the angular cross-sectional shape projecting in the direction perpendicular to the surface of the heater 242 that contacts the inner surface of the fixing film 24 of the heater 242 described above, and may be, for example, a round cross-sectional shape without corners, or it may have a flat cross-sectional shape that follows a predetermined guide direction on the inner surface of the fixing film 24. Further, the protruding portion may be provided at a position where it makes contacting the inner surface of the portion forming the fixing nip portion in the fixing film. That is, various shape configurations may be adopted, as appropriate, as long as the above-mentioned desired guide trajectory can be formed.

In Example 2-1 the height h of the step A was set to 0.20 mm. The height h of the step A is preferably at least 0.01 mm, and more preferably at least 0.10 mm, from the viewpoint of increasing the separation angle θ to improve the separability between the toner and the fixing film 24 on the output image. Meanwhile, the height h is preferably not more than 1.00 mm, more preferably not more than 0.50 mm, and even more preferably less than 0.50 mm from the viewpoint of avoiding the phenomenon that the toner is crushed and the gloss becomes high due to the pressure applied to the toner on the recording material after passing through the fixing nip portion Nf. The numerical ranges can be combined arbitrarily. The height h can be, for example, from 0.01 mm to 1.00 mm.

Further, it is preferable that the step A be present outside the region of the fixing nip portion Nf as shown in FIG. 10A. With such a configuration, the height h is made as large as possible both to ensure the separability of the toner on the paper and the fixing film 24, and to suppress the increase in the fixing nip pressure σ and the application of a stronger pressing force to the paper.

Even when the step A is provided outside the region of the fixing nip portion Nf, the height h is preferably at least 0.01 mm, and more preferably at least 0.10 mm. The height h is also preferably not more than 1.00 mm, more preferably not more than 0.50 mm, and even more preferably less than 0.50 mm. These numerical ranges can be combined arbitrarily. The height h can be, for example, from 0.01 mm to 1.00 mm.

When the height h is at least 0.01 mm, the separation angle θ can be increased, and the separability between the toner and the fixing film 24 on the output image can be improved. When the height h is not more than 1.00 mm, the inner peripheral length of the fixing film 24 required to accommodate the heater holder in the fixing film 24 can be reduced, which contributes to cost reduction. Further, when the height h is not more than 1.00 mm, it is possible to prevent the fixing film 24 from being repeatedly bent a plurality of times, which is preferable from the viewpoint of the durability of the fixing film. Where repeated bending occurs multiple times, cracks may appear in the longitudinal direction of the fixing film, and if these cracks grow, the fixing film may break and the fixing device may fail. Therefore, it is preferable to avoid repeated bending.

Further, the inner surface of the fixing film 24 may be coated with grease in order to stabilize the running of the fixing film 24. In the case of a fixing device in which grease is applied to the inner surface of the fixing film 24, where the step A is continuously present in the longitudinal direction of the fixing device 6, the step A may dam the grease. In such a case, a slit for passing grease may be cut in the step A.

Here, when the fixing nip pressure σ shown in FIGS. 10A and 10B was measured using the pressure distribution measurement system PINCH manufactured by Nitta Corporation, the fixing nip pressure σ was 0.12 MPa and the fixing nip width was 5 mm in both FIGS. 10A and 10B.

ating the fixing film contamination after durability is the same as the method described in the examples of the first embodiment, the description thereof is herein omitted. Table 4 shows the number of sheets in which the fixing film contamination has occurred.

In the configuration of Example 2-2, the toner 6 which had a high residual shape ratio of the toner of 70% and in which convex portions of the organosilicon polymer were formed on the outer surface of the toner particle was used. Therefore, both low gloss and suppression of fixing film contamination could be achieved. However, when the durability was considered, the fixing film was contaminated at the time of 40,000 sheets.

In Example 2-3, a step A was provided at the heater holder and the height h thereof was made 0.03 mm in order to reduce the contamination of the fixing film as compared with the configuration of Example 2-2. With this configuration, the fixing film contamination could be suppressed up to 50,000 sheets.

In Example 2-1, the height h of the step A was further increased to 0.20 mm as compared with Example 2-3. With this configuration, the fixing film was not contaminated even when the number of durable sheets reached 75,000.

By providing the heater holder with a step Ain this way, it was possible to suppress the fixing film contamination even after durability. Further, by setting the fixing nip pressure σ to satisfy G≥σ×0.6 as in the examples of the first embodiment, it was also possible to achieve both the low gloss of the output image and the suppression of fixing film contamination with the toner.

TABLE 4

| | Toner | | | | Fixing nip | | |
|---|---|---|---|---|---|---|---|
| | No | Organosilicon polymer | * | Viscoelasticity G of toner | pressure σ | Height h | P(D/W) |
| Example 2-1 | Toner 6 | Present | D = H | 0.080 MPa | 0.12 MPa | 0.20 mm | 90 |
| Example 2-2 | Toner 6 | Present | D = H | 0.080 MPa | 0.12 MPa | 0.00 mm | 90 |
| Example 2-3 | Toner 6 | Present | D = H | 0.080 MPa | 0.1 2MPa | 0.03 mm | 90 |

| | ΣW/L | H80 (nm) | Convex portion diameter R (nm) | Affixing ratio (%) | Shape retention ratio of toner | Gloss | Fixing film contamination (sheets) |
|---|---|---|---|---|---|---|---|
| Example 2-1 | 0.61 | 90 | 45 | 95 | 70% | 4.8 | >75,000 |
| Example 2-2 | 0.61 | 90 | 45 | 95 | 70% | 4.8 | 40,000 |
| Example 2-3 | 0.61 | 90 | 45 | 95 | 70% | 4.8 | 50,000 |

In Table 4. * denotes relationship between convex portiondiameter D and convex portion height H.

Verification Test Results

In order to confirm the effect of the above-described example, 75,000 sheets were actually passed through. An image that was solid black from the leading end of the paper to the central portion of the paper in FIG. 9 was outputted every 10,000 sheets, and the shape retention ratio and gloss of the toner and the contamination of the fixing film after durability were evaluated. The results are shown in Table 4.

In each of Examples 2-1 to 2-3, the shape retention ratio and gloss of the toner showed almost no change throughout the durability of 75,000 sheets, and the shape retention ratio and gloss at the time when the fixing film contamination occurred were recorded. Further, since the method for evalu- While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-005522, filed Jan. 16, 2020 which is hereby incorporated by reference herein in its entirety.

What is claimed is:

1. An image forming method for an image forming apparatus comprising an image forming unit and a fixing unit, the image forming unit being configured to form a toner image on a recording material, and the fixing unit being configured to fix the toner image formed on the recording material to the recording material, the fixing unit comprising a fixing film, a heating member provided in an inner space of the fixing film, and a pressure member that together with the heating member forms a fixing nip portion, with the fixing film being interposed between the pressure member and the heating member, the image forming method comprises a step of fixing the toner image to the recording material while nipping and conveying the recording material on which the toner image has been formed by the fixing nip portion, wherein the toner comprises a toner particle comprising a toner base particle and an organosilicon polymer on a surface of the toner base particle, the organosilicon polymer has a structure represented by $R—SiO_{3/2}$ where R is an alkyl group having from 1 to 6 carbon atoms or a phenyl group, the organosilicon polymer has convex portions formed on an outer surface of the toner particle, D=H when a contour line of the toner base particle in a cross-sectional image of the toner particle obtained by scanning transmission electron microscopy is straightened to a straight line having a length L, convex portion width W is a length of a line segment of a portion constituting a boundary of the convex portion and the toner base particle in the straight line, convex portion diameter D is a maximum length of the convex portion in a normal direction of the convex portion width W, and convex portion height H is a length to the straight line from an apex of the convex portion in the line segment forming the convex portion diameter D, $G \geq 0.060$ MPa and $G \geq \sigma \times 0.6$ when $\sigma$ (MPa) is a contact pressure of the pressure member and the fixing film and G (MPa) is a storage elastic modulus of the toner at a temperature of a surface of the fixing film when the recording material is nipped and conveyed by the fixing nip portion, and a shape retention ratio of the toner present on an outermost surface after passing through the fixing unit is at least 60%.

2. The image forming method according to claim 1, wherein the convex portion comprises specific-height convex portions in which H is 40 to 300 nm, and a number proportion P (D/W) of specific-height convex portions having a ratio D/W of the convex portion diameter D to the convex portion width W of from 0.33 to 0.80 is at least 70%.

3. The image forming method according to claim 2, wherein H80 is at least 65 nm when a cumulative distribution of the convex portion height H is obtained for the specific height convex portions and H80 is the convex portion height corresponding to 80% by number as integrated from the smaller convex portion height H.

4. The image forming method according to claim 1, wherein in the straightened image a ratio $\Sigma W/L$ is 0.30 to 0.90 where $\Sigma W$ is a total of the convex portion width W.

5. The image forming method according to claim 1, wherein an affixing ratio of the organosilicon polymer to the toner base particle is at least 80% by mass.

6. The image forming method according to claim 1, wherein a number average of R is 20 to 80 nm when R is a maximum diameter of the convex portion of the organosilicon polymer in observation of the toner with a scanning electron microscope.

7. The image forming method according to claim 1, wherein $10.0 \text{ MPa} \geq G$ and $10.0 \times \sigma \geq G$.

* * * * *